US011468853B2

(12) United States Patent
Roh et al.

(10) Patent No.: US 11,468,853 B2
(45) Date of Patent: Oct. 11, 2022

(54) GATE DRIVER AND DISPLAY APPARATUS INCLUDING THE SAME

(71) Applicant: Samsung Display Co., Ltd., Yongin-Si (KR)

(72) Inventors: Jinyoung Roh, Hwaseong-si (KR); Hongsoo Kim, Hwaseong-si (KR); Sehyuk Park, Seongnam-si (KR); Hyojin Lee, Seongnam-si (KR); Jaekeun Lim, Suwon-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 17/389,466

(22) Filed: Jul. 30, 2021

(65) Prior Publication Data

US 2022/0059039 A1 Feb. 24, 2022

(30) Foreign Application Priority Data

Aug. 18, 2020 (KR) ..... 10-2020-0103512

(51) Int. Cl.
*G09G 3/3291* (2016.01)
*G09G 3/3266* (2016.01)
*G09G 3/3233* (2016.01)

(52) U.S. Cl.
CPC ..... *G09G 3/3291* (2013.01); *G09G 3/3266* (2013.01); *G09G 2300/0426* (2013.01); *G09G 2310/08* (2013.01)

(58) Field of Classification Search
None
See application file for complete search history.

(56) References Cited

U.S. PATENT DOCUMENTS 8,803,784 B2 * 8/2014 Sakamoto ..... G09G 3/3677 377/79
10,923,012 B1 * 2/2021 Hu ..... G09G 3/3677
2006/0145991 A1 * 7/2006 Jang ..... G09G 3/3677 345/94
2006/0145998 A1 * 7/2006 Cho ..... G09G 3/3677 345/100
2007/0104307 A1 * 5/2007 Kim ..... G11C 19/28 377/64

(Continued)

FOREIGN PATENT DOCUMENTS

KR 10-2013-0031820 A 3/2013
KR 10-1769586 B1 8/2017
KR 10-2070660 B1 1/2020

*Primary Examiner* — Sepehr Azari
(74) *Attorney, Agent, or Firm* — Innovation Counsel LLP

(57) ABSTRACT

A gate driver includes a first stage, a second stage, a third stage and a fourth stage. The first stage includes a first clock terminal receiving a first clock signal, a second clock terminal receiving a second clock signal, a carry terminal receiving a vertical start signal and an output terminal outputting a first gate output signal. The second stage includes a first clock terminal receiving the second clock signal, a second clock terminal receiving the first clock signal, a carry terminal receiving the vertical start signal and an output terminal outputting a second gate output signal. The third stage includes a first clock terminal receiving the second clock signal, a second clock terminal receiving the first clock signal, a carry terminal receiving the first gate output signal and an output terminal outputting a third gate output signal.

20 Claims, 14 Drawing Sheets

(56) References Cited

U.S. PATENT DOCUMENTS

| | | | | |
|---|---|---|---|---|
| 2009/0040161 | A1* | 2/2009 | Baek | G11C 19/28 345/94 |
| 2011/0157263 | A1* | 6/2011 | Kim | G09G 3/3677 345/698 |
| 2012/0001894 | A1* | 1/2012 | Kim | G09G 3/3677 327/108 |
| 2013/0335392 | A1* | 12/2013 | Cho | G11C 19/28 327/108 |
| 2015/0103068 | A1* | 4/2015 | Kim | G09G 3/296 345/99 |
| 2016/0125954 | A1* | 5/2016 | Gu | G09G 3/3688 377/64 |
| 2017/0052635 | A1* | 2/2017 | Yu | G09G 3/20 |
| 2017/0278473 | A1* | 9/2017 | Shang | G09G 3/36 |

* cited by examiner

GATE DRIVER AND DISPLAY APPARATUS INCLUDING THE SAME

PRIORITY STATEMENT

This application claims priority under 35 U.S.C. § 119 to Korean Patent Application No. 10-2020-0103512, filed on Aug. 18, 2020, in the Korean Intellectual Property Office KIPO, the contents of which are herein incorporated by reference in their entireties.

BACKGROUND

1. Field

Example embodiments of the present inventive concept relate to a gate driver and a display apparatus including the gate driver. More particularly, example embodiments of the present inventive concept relate to a gate driver dividing gate lines into two groups for low frequency driving and a display apparatus including the gate driver.

2. Description of the Related Art

Generally, a display apparatus includes a display panel and a display panel driver. The display panel includes a plurality of gate lines, a plurality of data lines, a plurality of emission lines and a plurality of pixels. The display panel driver includes a gate driver, a data driver, an emission driver and a driving controller. The gate driver outputs gate signals to the gate lines. The data driver outputs data voltages to the data lines. The emission driver outputs emission signals to the emission lines. The driving controller controls the gate driver, the data driver and the emission driver. In addition, the display panel driver may further include a power voltage generator applying a power voltage and an initialization voltage to the display panel.

The driving controller may determine a driving frequency of a display panel based on input image data. When the input image data represent a static image, the driving controller may drive the display panel in a relatively low driving frequency so that a power consumption of the display apparatus may be reduced.

To drive the display panel in the low driving frequency, the gate driver may divide and drive the gate lines into two groups. To drive the gate lines into two groups, the number of clock lines applying clock signals to the stages of the gate driver may be doubled so that a dead space of the display apparatus may increase.

SUMMARY

Example embodiments of the present inventive concept provide a gate driver dividing and driving gate lines into two groups using two gate clock lines for low frequency driving.

Example embodiments of the present inventive concept also provide a display apparatus including the gate driver.

In an example embodiment of a gate driver according to the present inventive concept, the gate driver includes a first stage, a second stage, a third stage and a fourth stage. The first stage includes a first clock terminal configured to receive a first clock signal, a second clock terminal configured to receive a second clock signal, a carry terminal configured to receive a vertical start signal and an output terminal configured to output a first gate output signal. The second stage includes a first clock terminal configured to receive the second clock signal, a second clock terminal configured to receive the first clock signal, a carry terminal configured to receive the vertical start signal and an output terminal configured to output a second gate output signal. The third stage includes a first clock terminal configured to receive the second clock signal, a second clock terminal configured to receive the first clock signal, a carry terminal configured to receive the first gate output signal and an output terminal configured to output a third gate output signal. The fourth stage includes a first clock terminal configured to receive the first clock signal, a second clock terminal configured to receive the second clock signal, a carry terminal configured to receive the second gate output signal and an output terminal configured to output a fourth gate output signal.

In an example embodiment, when input image data represent a moving image, the gate driver may be driven in a first driving frequency. When the input image data represent a static image, the gate driver may be driven in a second driving frequency which is a half of the first driving frequency.

In an example embodiment, when the input image data represent the static image, the gate driver may be configured to output gate output signals only to odd numbered gate lines in a first frame and gate output signals only to even numbered gate lines in a second frame.

In an example embodiment, when the input image data represent the moving image, the gate driver may be configured to output gate output signals only to the odd numbered gate lines in a first subframe of a first frame, gate output signals only to the even numbered gate lines in a second subframe of the first frame, gate output signals only to the odd numbered gate lines in a first subframe of a second frame and gate output signals only to the even numbered gate lines in a second subframe of the second frame.

In an example embodiment, the first stage may include a first switching element comprising a control electrode configured to receive the first clock signal, an input electrode configured to receive the vertical start signal and an output electrode connected to a first control nod of the first stage e, a second switching element comprising a control electrode connected to a second control node of the first stage, an input electrode configured to receive a first gate power voltage and an output electrode , a third switching element comprising a control electrode configured to receive the second clock signal, an input electrode connected to the output electrode of the second switching element of the first stage and an output electrode connected to the first control node of the first stage, a fourth switching element comprising a control electrode connected to the first control node of the first stage, an input electrode connected to the second control node of the first stage and an output electrode connected to the first control node of the first stage, a fifth switching element comprising a control electrode configured to receive the first clock signal, an input electrode configured to receive a second gate power voltage different from the first gate power voltage and an output electrode connected to the second control node of the first stage, a sixth switching element comprising a control electrode connected to the second control node of the first stage, an input electrode configured to receive the first gate power voltage and an output electrode connected to the output terminal of the first stage and a seventh switching element comprising a control electrode connected to the first control node of the first stage, an input electrode configured to receive the second clock signal and an output electrode connected to the output terminal of the first stage.

In an example embodiment, the second stage may include a first switching element comprising a control electrode configured to receive the second clock signal, an input electrode configured to receive the vertical start signal and an output electrode connected to a first control node of the second stage, a second switching element comprising a control electrode connected to a second control node of the second stage, an input electrode configured to receive a first gate power voltage and an output electrode connected to an input electrode of a third switching element, a third switching element comprising a control electrode configured to receive the second clock signal, the input electrode connected to the output electrode of the second switching element of the second stage and an output electrode connected to the first control node of the second stage, a fourth switching element comprising a control electrode connected to the first control node of the second stage, an input electrode connected to the second control node of the second stage and an output electrode connected to the first control node of the second stage, a fifth switching element comprising a control electrode configured to receive the first clock signal, an input electrode configured to receive a second gate power voltage different from the first gate power voltage and an output electrode connected to the second control node of the second stage, a sixth switching element comprising a control electrode connected to the second control node of the second stage, an input electrode configured to receive the first gate power voltage and an output electrode connected to the output terminal of the second stage and a seventh switching element comprising a control electrode connected to the first control node of the second stage, an input electrode configured to receive the second clock signal and an output electrode connected to the output terminal of the second stage.

In an example embodiment, the first stage may be configured to output the first gate output signal in response to the vertical start signal having an active period overlapped with an active period of the first clock signal. The second stage may be configured to output the second gate output signal in response to the vertical start signal having an active period overlapped with an active period of the second clock signal.

In an example embodiment, the gate driver may further include a vertical start signal line commonly connected to the carry terminal of the first stage and the carry terminal of the second stage.

In an example embodiment, the gate driver may further include a first vertical start signal line connected to the carry terminal of the first stage and a second vertical start signal line connected to the carry terminal of the second stage.

In an example embodiment of a gate driver according to the present inventive concept, the gate driver includes a first stage, a second stage, a third stage, a fourth stage, a fifth stage, a sixth stage, a seventh stage and an eight stage. The first stage includes a first clock terminal configured to receive a first clock signal, a second clock terminal configured to receive a second clock signal, a carry terminal configured to receive a vertical start signal and an output terminal configured to output a first gate output signal. The second stage includes a first clock terminal configured to receive the second clock signal, a second clock terminal configured to receive the first clock signal, a carry terminal configured to receive the first gate output signal and an output terminal configured to output a second gate output signal. The third stage includes a first clock terminal configured to receive the second clock signal, a second clock terminal configured to receive the first clock signal, a carry terminal configured to receive the vertical start signal and an output terminal configured to output a third gate output signal. The fourth stage includes a first clock terminal configured to receive the first clock signal, a second clock terminal configured to receive the second clock signal, a carry terminal configured to receive the third gate output signal and an output terminal configured to output a fourth gate output signal. The fifth stage includes a first clock terminal configured to receive the first clock signal, a second clock terminal configured to receive the second clock signal, a carry terminal configured to receive the second gate output signal and an output terminal configured to output a fifth gate output signal. The sixth stage includes a first clock terminal configured to receive the second clock signal, a second clock terminal configured to receive the first clock signal, a carry terminal configured to receive the fifth gate output signal and an output terminal configured to output a sixth gate output signal. The seventh stage includes a first clock terminal configured to receive the second clock signal, a second clock terminal configured to receive the first clock signal, a carry terminal configured to receive the fourth gate output signal and an output terminal configured to output a seventh gate output signal. The eight stage includes a first clock terminal configured to receive the first clock signal, a second clock terminal configured to receive the second clock signal, a carry terminal configured to receive the seventh gate output signal and an output terminal configured to output an eighth gate output signal.

In an example embodiment, when input image data represent a moving image, the gate driver may be driven in a first driving frequency. When the input image data represent a static image, the gate driver may be driven in a second driving frequency which is a half of the first driving frequency.

In an example embodiment, when the input image data represent the static image, the gate driver may be configured to output gate output signals only to 4N-3-th gate lines and 4N-2-th gate lines in a first frame and gate output signals only to 4N-1-th gate lines and 4N-th gate lines in a second frame. N is a positive integer.

In an example embodiment, when the input image data represent the moving image, the gate driver may be configured to output gate output signals only to the 4N-3-th gate lines and the 4N-2-th gate lines in a first subframe of a first frame, gate output signals only to the 4N-1-th gate lines and the 4N-th gate lines in a second subframe of the first frame, gate output signals only to the 4N-3-th gate lines and the 4N-2-th gate lines in a first subframe of a second frame and gate output signals only to the 4N-1-th gate lines and the 4N-th gate lines in a second subframe of the second frame.

In an example embodiment of a display apparatus according to the present inventive concept, the display apparatus includes a display panel, a gate driver, a data driver and a driving controller. The display panel includes a plurality of pixels. The display panel is configured to display an image based on input image data. The gate driver is configured to output a plurality of gate signals to a plurality of gate lines of the display panel. The data driver is configured to output a plurality of data voltages to a plurality of data lines of the display panel. The driving controller is configured to determine a driving mode of the input image data. The gate driver includes a first stage comprising a first clock terminal configured to receive a first clock signal, a second clock terminal configured to receive a second clock signal, a carry terminal configured to receive a vertical start signal and an output terminal configured to output a first gate output signal, a second stage comprising a first clock terminal configured to receive the second clock signal, a second clock terminal configured to receive the first clock signal, a carry terminal configured to receive the vertical start signal and an output terminal configured to output a second gate output signal, a third stage comprising a first clock terminal configured to receive the second clock signal, a second clock terminal configured to receive the first clock signal, a carry terminal configured to receive the first gate output signal and an output terminal configured to output a third gate output signal and a fourth stage comprising a first clock terminal configured to receive the first clock signal, a second clock terminal configured to receive the second clock signal, a carry terminal configured to receive the second gate output signal and an output terminal configured to output a fourth gate output signal.

In an example embodiment, when the input image data represent a moving image, the gate driver may be driven in a first driving frequency. When the input image data represent a static image, the gate driver may be driven in a second driving frequency which is a half of the first driving frequency.

In an example embodiment, when the input image data represent the static image, the gate driver may be configured to output gate output signals only to odd numbered gate lines in a first frame and gate output signals only to even numbered gate lines in a second frame.

In an example embodiment, when the input image data represent the moving image, the gate driver may be configured to output gate output signals only to the odd numbered gate lines in a first subframe of a first frame, gate output signals only to the even numbered gate lines in a second subframe of the first frame, gate output signals only to the odd numbered gate lines in a first subframe of a second frame and gate output signals only to the even numbered gate lines in a second subframe of the second frame.

In an example embodiment, at least one of the pixels may include a first pixel switching element including a control electrode connected to a first node, an input electrode connected to a second node and an output electrode connected to a third node, a second pixel switching element including a control electrode to which a data write gate signal is applied, an input electrode to which the data voltage is applied and an output electrode connected to the second node, a third pixel switching element including a control electrode to which the data write gate signal is applied, an input electrode connected to the first node and an output electrode connected to the third node, a fourth pixel switching element including a control electrode to which a data initialization gate signal is applied, an input electrode to which the initialization voltage is applied and an output electrode connected to the first node, a fifth pixel switching element including a control electrode to which the emission signal is applied, an input electrode to which a high power voltage is applied and an output electrode connected to the second node, a sixth pixel switching element including a control electrode to which the emission signal is applied, an input electrode connected to the third node and an output electrode connected to an anode electrode of an organic light emitting element, a seventh pixel switching element including a control electrode to which the data initialization gate signal is applied, an input electrode to which an initialization voltage is applied and an output electrode connected to the anode electrode of the organic light emitting element, a storage capacitor including a first electrode to which the high power voltage is applied and a second electrode connected to the first node and the organic light emitting element including the anode electrode and a cathode electrode to which a low power voltage is applied.

In an example embodiment, the first stage may include a first switching element comprising a control electrode configured to receive the first clock signal, an input electrode configured to receive the vertical start signal and an output electrode connected to a first control node of the first stage, a second switching element comprising a control electrode connected to a second control node of the first stage, an input electrode configured to receive a first gate power voltage and an output electrode, a third switching element comprising a control electrode configured to receive the second clock signal, an input electrode connected to the output electrode of the second switching element of the first stage and an output electrode connected to the first control node of the first stage, a fourth switching element comprising a control electrode connected to the first control node of the first stage, an input electrode connected to the second control node of the first stage and an output electrode connected to the first control node of the first stage, a fifth switching element comprising a control electrode configured to receive the first clock signal, an input electrode configured to receive a second gate power voltage different from the first gate power voltage and an output electrode connected to the second control node of the first stage, a sixth switching element comprising a control electrode connected to the second control node of the first stage, an input electrode configured to receive the first gate power voltage and an output electrode connected to the output terminal of the first stage and a seventh switching element comprising a control electrode connected to the first control node of the first stage, an input electrode configured to receive the second clock signal and an output electrode connected to the output terminal of the first stage.

In an example embodiment, the second stage may include a first switching element comprising a control electrode configured to receive the second clock signal, an input electrode configured to receive the vertical start signal and an output electrode connected to a first control node of the second stage, a second switching element comprising a control electrode connected to a second control node of the second stage, an input electrode configured to receive a first gate power voltage and an output electrode, a third switching element comprising a control electrode configured to receive the second clock signal, an input electrode connected to the output electrode of the second switching element and an output electrode connected to the first control node of the second stage, a fourth switching element comprising a control electrode connected to the first control node of the second stage, an input electrode connected to the second control node of the second stage and an output electrode connected to the first control node of the second stage, a fifth switching element comprising a control electrode configured to receive the first clock signal, an input electrode configured to receive a second gate power voltage different from the first gate power voltage and an output electrode connected to the second control node of the second stage, a sixth switching element comprising a control electrode connected to the second control node of the second stage, an input electrode configured to receive the first gate power voltage and an output electrode connected to the output terminal of the first stage and a seventh switching element comprising a control electrode connected to the first control node of the second stage, an input electrode configured to receive the second clock signal and an output electrode connected to the output terminal of the first stage.

According to the gate driver and the display apparatus including the gate driver, the driving controller drives the display panel in the moving image driving frequency in the moving image mode, and the driving controller drives the display panel in the static image driving frequency in the static image mode. Thus, the power consumption of the display apparatus may be reduced.

In addition, in the static image mode, the gate driver scans the first group of the gate lines in a first duration and the second group of the gate lines in a second duration so that the flicker due to the current leakage of the pixel may be prevented.

In addition, in the static image mode, the gate lines are driven into two groups using only two gate clock lines so that the dead space of the display apparatus may be reduced.

BRIEF DESCRIPTION OF THE DRAWINGS

The above and other features and advantages of the present inventive concept will become more apparent by describing in detailed example embodiments thereof with reference to the accompanying drawings, in which.

DETAILED DESCRIPTION OF THE INVENTIVE CONCEPT

Hereinafter, the present inventive concept will be explained in detail with reference to the accompanying drawings.

Figure 1:
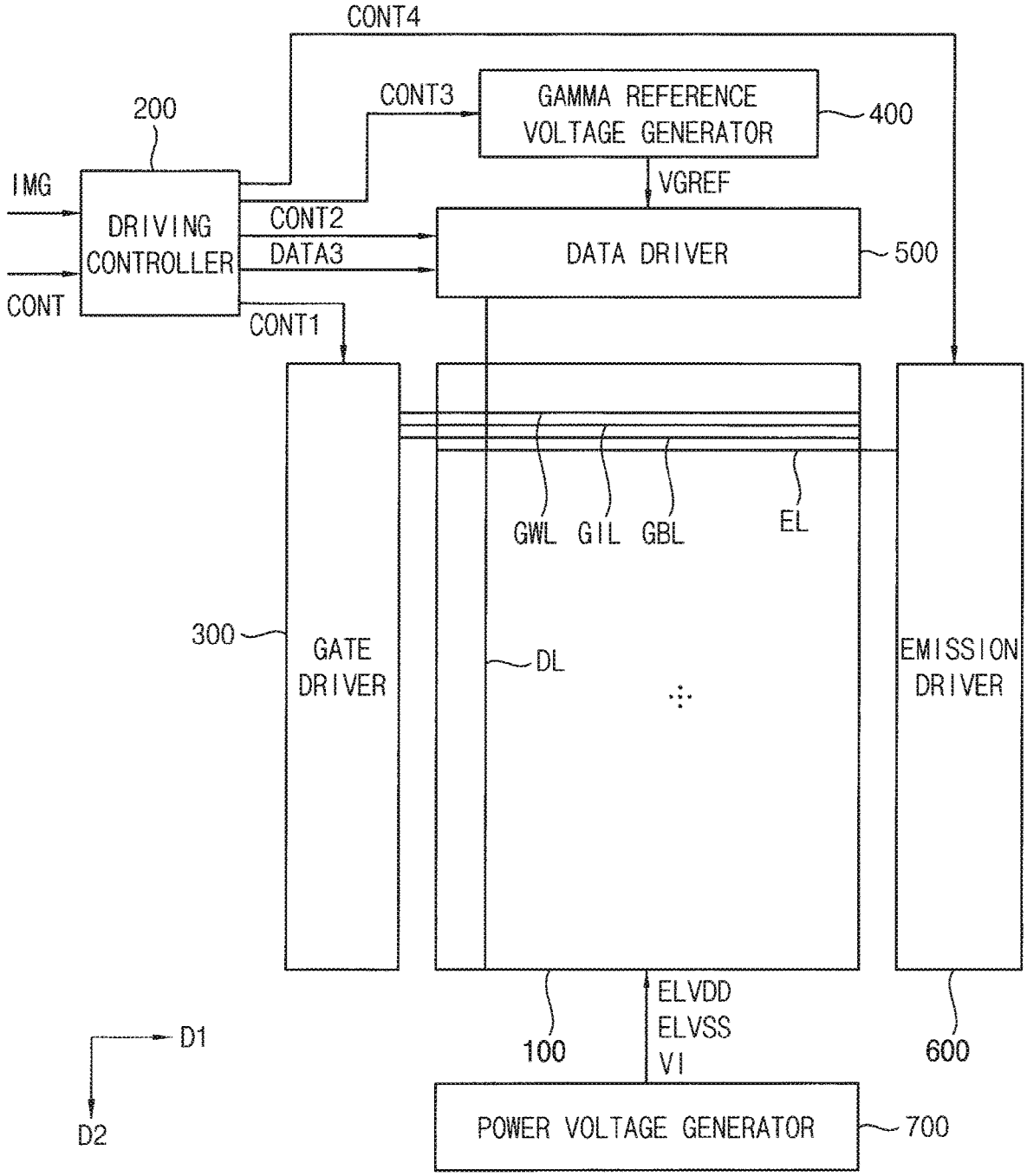
FIG. 1 is a block diagram illustrating a display apparatus according to an example embodiment of the present inventive concept.

FIG. 1 is a block diagram illustrating a display apparatus according to an example embodiment of the present inventive concept.

Referring to FIG. 1, the display apparatus includes a display panel 100 and a display panel driver. The display panel driver includes a driving controller 200, a gate driver 300, a gamma reference voltage generator 400, a data driver 500 and an emission driver 600. The display panel driver may further include a power voltage generator 700.

The driving controller 200 and the data driver 500 may be integrally formed in one IC chip. The driving controller 200, the data driver 500 and the power voltage generator 700 may be integrally formed in one IC chip. The driving controller 200, the gamma reference voltage generator 400 and the data driver 500 may be integrally formed in one IC chip. The driving controller 200, the gate driver 300, the gamma reference voltage generator 400 and the data driver 500 may be integrally formed in one IC chip. The driving controller 200, the gate driver 300, the gamma reference voltage generator 400, the data driver 500 and the emission driver 600 may be integrally formed in one IC chip. The driving controller 200, the gate driver 300, the gamma reference voltage generator 400, the data driver 500, the emission driver 600 and the power voltage generator 700 may be integrally formed in one IC chip.

The display panel 100 includes a plurality of gate lines GWL, GIL and GBL, a plurality of data lines DL, a plurality of emission lines EL and a plurality of pixels electrically connected to the gate lines GWL, GIL and GBL, the data lines DL and the emission lines EL. respectively. The gate lines GWL, GIL and GBL extend in a first direction D1, the data lines DL extend in a second direction D2 crossing the first direction D1 and the emission lines EL extend in the first direction D1.

The driving controller 200 receives input image data IMG and an input control signal CONT from an external apparatus. For example, the input image data IMG may include red image data, green image data and blue image data. The input image data IMG may include white image data. The input image data IMG may include magenta image data, cyan image data and yellow image data. The input control signal CONT may include a master clock signal and a data enable signal. The input control signal CONT may further include a vertical synchronizing signal and a horizontal synchronizing signal.

The driving controller 200 generates a first control signal CONT1, a second control signal CONT2, a third control signal CONT3, a fourth control signal CONT4 and a data signal DATA based on the input image data IMG and the input control signal CONT.

The driving controller 200 generates the first control signal CONT 1 for controlling an operation of the gate driver 300 based on the input control signal CONT, and outputs the first control signal CONTI to the gate driver 300. The first control signal CONT1 may include a vertical start signal and a gate clock signal.

The driving controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The driving controller 200 generates the data signal DATA based on the input image data IMG. The driving controller 200 outputs the data signal DATA to the data driver 500.

The driving controller 200 generates the third control signal CONT3 for controlling an operation of the gamma reference voltage generator 400 based on the input control signal CONT and outputs the third control signal CONT3 to the gamma reference voltage generator 400.

The driving controller 200 generates the fourth control signal CONT4 for controlling an operation of the emission driver 600 based on the input control signal CONT and outputs the fourth control signal CONT4 to the emission driver 600.

The gate driver 300 generates gate signals driving the gate lines GWL, GIL and GBL in response to the first control signal CONTI received from the driving controller 200. The gate driver 300 may sequentially output the gate signals to the gate lines GWL, GIL and GBL. The gate driver 300 may be mounted on the display panel 100. The gate driver 300 may be directly integrated on the display panel 100.

The gamma reference voltage generator 400 generates a gamma reference voltage VGREF in response to the third control signal CONT3 received from the driving controller 200. The gamma reference voltage generator 400 provides the gamma reference voltage VGREF to the data driver 500. The gamma reference voltage VGREF has a value corresponding to a level of the data signal DATA.

In an example embodiment, the gamma reference voltage generator 400 may be disposed in the driving controller 200, or in the data driver 500.

The data driver 500 receives the second control signal CONT2 and the data signal DATA from the driving controller 200, and receives the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL.

The emission driver 600 generates emission signals to drive the emission lines EL in response to the fourth control signal CONT4 received from the driving controller 200. The emission driver 600 may output the emission signals to the emission lines EL.

The power voltage generator 700 may generate power voltage for operating the display panel 100 and the display panel driver. For example, the power voltage generator 700 may output a high power voltage ELVDD to a pixel circuit of the display panel 100. For example, the power voltage generator 700 may output a low power voltage ELVSS to the pixel circuit of the display panel 100. For example, the power voltage generator 700 may output an initialization voltage VI to the pixel circuit of the display panel 100.

Figure 2:
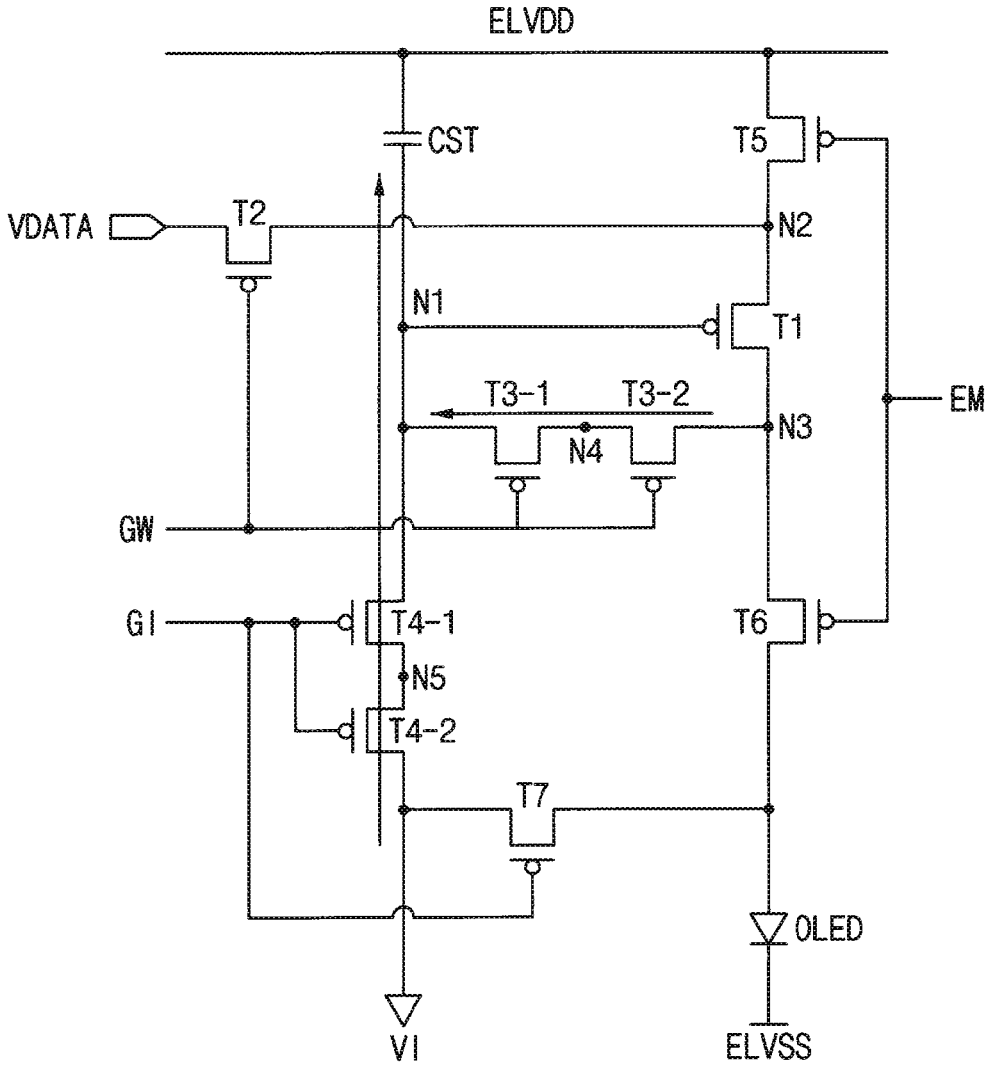
FIG. 2 is a circuit diagram illustrating a pixel of a display panel of FIG. 1.
Figure 3:
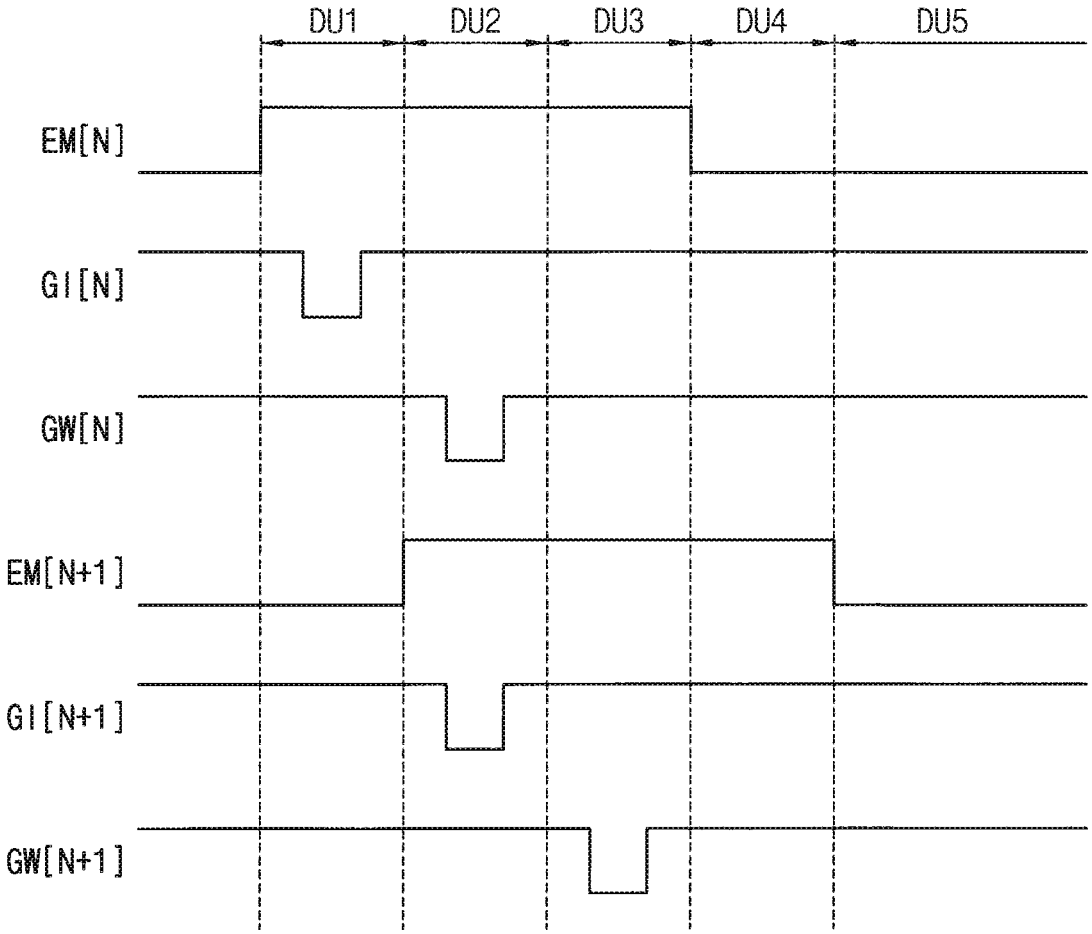
FIG. 3 is a timing diagram illustrating input signals applied to the pixel of FIG. 2.

FIG. 2 is a circuit diagram illustrating the pixel of the display panel 100 of FIG. 1. FIG. 3 is a timing diagram illustrating input signals applied to the pixel of FIG. 2.

Referring to FIGS. 1 to 3, the display panel 100 includes the plurality of the pixels. Each pixel includes an organic light emitting element OLED.

The pixels receive a data write gate signal GW, a data initialization gate signal GI, an organic light emitting element initialization gate signal, the data voltage VDATA and the emission signal EM. The organic light emitting elements OLED of the pixels emit light corresponding to the level of the data voltage VDATA to display the image. In the present example embodiment, the organic light emitting element initialization gate signal may be the same as the data initialization gate signal GI.

At least one of the pixels may include first to seventh pixel switching elements T1 to T7, a storage capacitor CST and the organic light emitting element OLED.

The first pixel switching element T1 includes a control electrode connected to a first node N1, an input electrode connected to a second node N2 and an output electrode connected to a third node N3. The first pixel switching element T1 may be a P-type thin film transistor. The control electrode of the first pixel switching element T1 may be a gate electrode, the input electrode of the first pixel switching element T1 may be a source electrode and the output electrode of the first pixel switching element T1 may be a drain electrode.

The second pixel switching element T2 includes a control electrode to which the data write gate signal GW is applied, an input electrode to which the data voltage VDATA is applied and an output electrode connected to the second node N2. The second pixel switching element T2 may be a P-type thin film transistor. The control electrode of the second pixel switching element T2 may be a gate electrode, the input electrode of the second pixel switching element T2 may be a source electrode and the output electrode of the second pixel switching element T2 may be a drain electrode.

The third pixel switching element T3-1 and T3-2 includes a control electrode to which the data write gate signal GW is applied, an input electrode connected to the first node N1 and an output electrode connected to the third node N3. The third pixel switching element T3-1 and T3-2 may be a P-type thin film transistor. The control electrode of the third pixel switching element T3-1 and T3-2 may be a gate electrode, the input electrode of the third pixel switching element T3-1 and T3-2 may be a source electrode and the output electrode of the third pixel switching element T3-1 and T3-2 may be a drain electrode.

As shown in FIG. 2, for example, the third pixel switching element may include two pixel switching elements T3-1 and T3-2 connected to each other in series. Unlike FIG. 2, the third pixel switching element may be configured as a single switching element.

The fourth pixel switching element T4-1 and T4-2 includes a control electrode to which the data initialization gate signal GI is applied, an input electrode to which an initialization voltage VI is applied and an output electrode connected to the first node N1. The fourth pixel switching element T4-1 and T4-2 may be a P-type thin film transistor. The control electrode of the fourth pixel switching element T4-1 and T4-2 may be a gate electrode, the input electrode of the fourth pixel switching element T4-1 and T4-2 may be a source electrode and the output electrode of the fourth pixel switching element T4-1 and T4-2 may be a drain electrode.

As shown in FIG. 2, for example, the fourth pixel switching element may include two pixel switching elements T4-1 and T4-2 connected to each other in series. Unlike FIG. 2, the fourth pixel switching element may be configured as a single switching element.

The fifth pixel switching element T5 includes a control electrode to which the emission signal EM is applied, an input electrode to which a high power voltage ELVDD is applied and an output electrode connected to the second node N2. The fifth pixel switching element T5 may be a P-type thin film transistor. The control electrode of the fifth pixel switching element T5 may be a gate electrode, the input electrode of the fifth pixel switching element T5 may be a source electrode and the output electrode of the fifth pixel switching element T5 may be a drain electrode.

The sixth pixel switching element T6 includes a control electrode to which the emission signal EM is applied, an input electrode connected to the third node N3 and an output electrode connected to an anode electrode of the organic light emitting element OLED. The sixth pixel switching element T6 may be a P-type thin film transistor. The control electrode of the sixth pixel switching element T6 may be a gate electrode, the input electrode of the sixth pixel switching element T6 may be a source electrode and the output electrode of the sixth pixel switching element T6 may be a drain electrode.

The seventh pixel switching element T7 includes a control electrode to which the organic light emitting element initialization gate signal GI is applied, an input electrode to which the initialization voltage VI is applied and an output electrode connected to the anode electrode of the organic light emitting element OLED. The seventh pixel switching element T7 may be a P-type thin film transistor. The control electrode of the seventh pixel switching element T7 may be a gate electrode, the input electrode of the seventh pixel switching element T7 may be a source electrode and the output electrode of the seventh pixel switching element T7 may be a drain electrode.

The storage capacitor CST includes a first electrode to which the high power voltage ELVDD is applied and a second electrode connected to the first node N1.

The organic light emitting element OLED includes the anode electrode and a cathode electrode to which a low power voltage ELVSS is applied.

In FIG. 3, in a pixel disposed in an N-th row, the first node N1 and the storage capacitor CST are initialized in response to the data initialization gate signal GI[N] during a first duration DU1. During the first duration DU1, the anode electrode of the organic light emitting element OLED is initialized in response to the organic light emitting element initialization gate signal GI[N]. During a second duration DU2, a threshold voltage |VTH| of the first pixel switching element T1 is compensated and the data voltage VDATA of which the threshold voltage |VTH| is compensated is written to the storage capacitor CST in response to the data write gate signal GW[N]. During a fourth duration DU4, a fifth duration DU5 and after the fifth duration DU5, the organic light emitting element OLED emits the light in response to the emission signal EM[N] so that the pixels in the N-th row display the image.

In a pixel disposed in an (N+1)-th row, during the second duration DU2, the first node N1 and the storage capacitor CST are initialized in response to the data initialization gate signal GI[N+1]. During the second duration DU2, the anode electrode of the organic light emitting element OLED is initialized in response to the organic light emitting element initialization gate signal GI[N+1]. During a third duration DU3, a threshold voltage |VTH| of the first pixel switching element T1 is compensated and the data voltage VDATA of which the threshold voltage |VTH| is compensated is written to the storage capacitor CST in response to the data write gate signal GW[N+1]. During the fifth duration DU5 and after the fifth duration DU5, the organic light emitting element OLED emits the light in response to the emission signal EM[N+1] so that the pixels in the N-th row display the image.

In the pixel disposed in an N-th row, during the first duration DU1, the data initialization gate signal GI[N] may have an active level. For example, the active level of the data initialization gate signal GI[N] may be a low level. When the data initialization gate signal GI[N] has the active level, the fourth pixel switching element T4-1 and T4-2 of the pixel of the N-th row is turned on so that the initialization voltage VI may be applied to the first node N1.

During the first duration DU1, the organic light emitting element initialization gate signal GI[N] may have an active level. In the present example embodiment, the organic light emitting element initialization gate signal GI[N] may be the same as the data initialization gate signal GI[N]. When the organic light emitting element initialization gate signal GI[N] has the active level, the seventh pixel switching element T7 of the pixel of the N-th row is turned on so that the initialization voltage VI may be applied to the anode electrode of the organic light emitting element OLED.

In the pixel disposed in an N-th row, the data write gate signal GW[N] may have an active level during the second duration DU2. For example, the active level of the data write gate signal GW[N] may be a low level. When the data write gate signal GW[N] has the active level, the second pixel switching element T2 and the third pixel switching element T3-1 and T3-2 of the pixel of the N-th row are turned on. In addition, the first pixel switching element T1 of the pixel of the N-th row is turned on in response to the initialization voltage VI.

A voltage which is subtraction an absolute value |VTH| of the threshold voltage of the first pixel switching element T1 from the data voltage VDATA may be charged at the storage capacitor CST of the pixel of the N-th row along a path generated by the first to third pixel switching elements T1, T2 and T3-1 and T3-2.

During the fourth duration DU4 and the fifth duration DU5, the emission signal EM[N] corresponding to the N-th row may have an active level. The active level of the emission signal EM[N] may be a low level. When the emission signal EM[N] has the active level, the fifth pixel switching element T5 and the sixth pixel switching element T6 of the pixel of the N-th row are turned on. In addition, the first pixel switching element T1 of the pixel of the N-th row is turned on by the data voltage VDATA.

Figure 4:
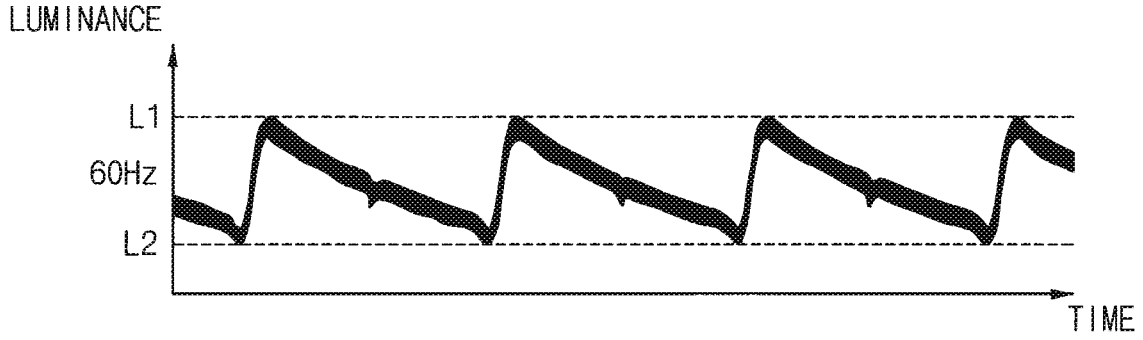
FIG. 4 is a graph illustrating a decrease of a luminance due to a current leakage of a pixel of FIG. 2 in a first driving frequency.
Figure 5:
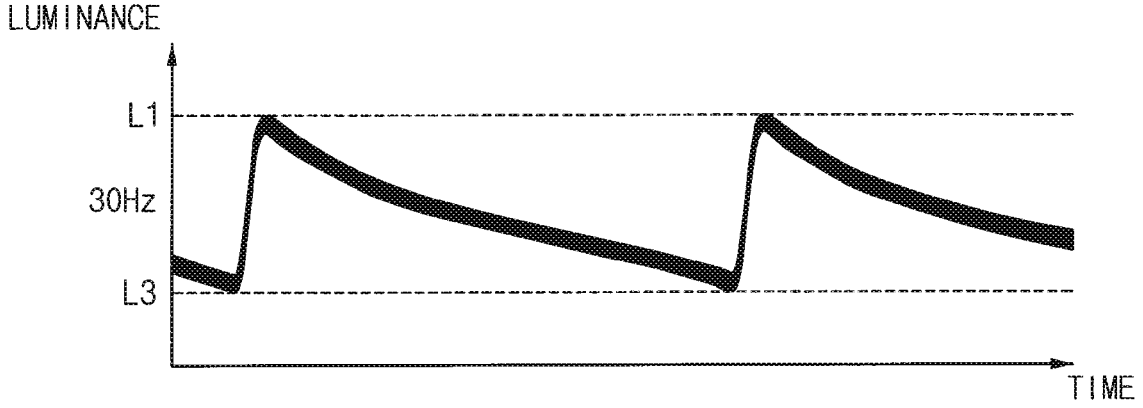
FIG. 5 is a graph illustrating a decrease of a luminance due to a current leakage of the pixel of FIG. 2 in a second driving frequency.

FIG. 4 is a graph illustrating a decrease of a luminance due to a current leakage of a pixel of FIG. 2 in a first driving frequency. FIG. 5 is a graph illustrating a decrease of a luminance due to a current leakage of the pixel of FIG. 2 in a second driving frequency.

Referring to FIGS. 1 to 5, the driving controller 200 may determine a moving image mode and a static image mode according to the input image data IMG. In the moving image mode, the driving controller 200 may drive the display panel 100 in a moving image driving frequency. In the static image mode, the driving controller 200 may drive the display panel 100 in a static image driving frequency.

For example, the moving image driving frequency may be 60 Hz. Alternatively, the moving image driving frequency may be 120 Hz or 240 Hz. The static image driving frequency may be equal to or less than the moving image driving frequency. The driving controller 200 may properly determine the static image driving frequency according to the input image data IMG.

For example, the driving frequency may be 60 Hz in FIG. 4 and the driving frequency may be 30 Hz in FIG. 5. The charge stored in the storage capacitor CST of the pixel may be leaked through the third pixel switching element T3-1 and T3-2 and the fourth pixel switching element T4-1 and T4-2. Due to the current leakage of the pixel, the luminance of the display panel 100 may be decreased. In FIG. 4, when driving the display panel 10 in 60 Hz, the driving frequency is relatively high and accordingly the data voltage VDATA is refreshed in a high frequency so that the decrease of the luminance due to the current leakage may be relatively small. For example, the luminance of the display panel 100 may be decreased from a first luminance L1 to a second luminance L2 due to the current leakage in FIG. 4. In contrast, in FIG. 5, when driving the display panel 10 in 30 Hz, the driving frequency is relatively low and accordingly the data voltage VDATA is refreshed in a low frequency so that the decrease of the luminance due to the current leakage may be relatively great. For example, the luminance of the display panel 100 may be decreased from the first luminance L1 to a third luminance L3 which is lower than the second luminance L2 due to the current leakage in FIG. 5. The decrease of the luminance in FIG. 5 may generate a flicker.

In a period when the pixel emits light, the voltages of the fourth node N4 and the fifth node N5 are floated so that the voltages of the fourth node N4 and the fifth node N5 may almost reach a high level of the gate signal, and thus, the leakage current may flow in a direction from the third pixel switching element T3-1 and T3-2 and the fourth pixel switching element T4-1 and T4-2 to the storage capacitor CST.

Figure 6:
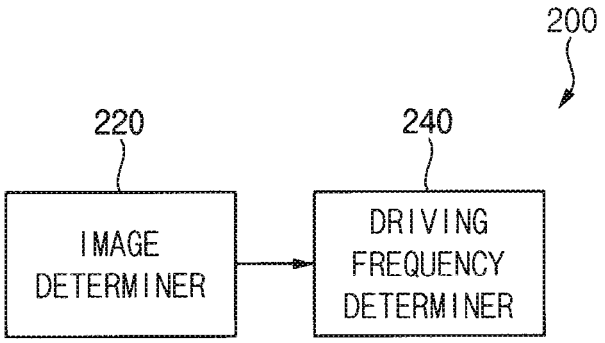
FIG. 6 is a block diagram illustrating a driving driver of FIG. 1.
Figure 7:
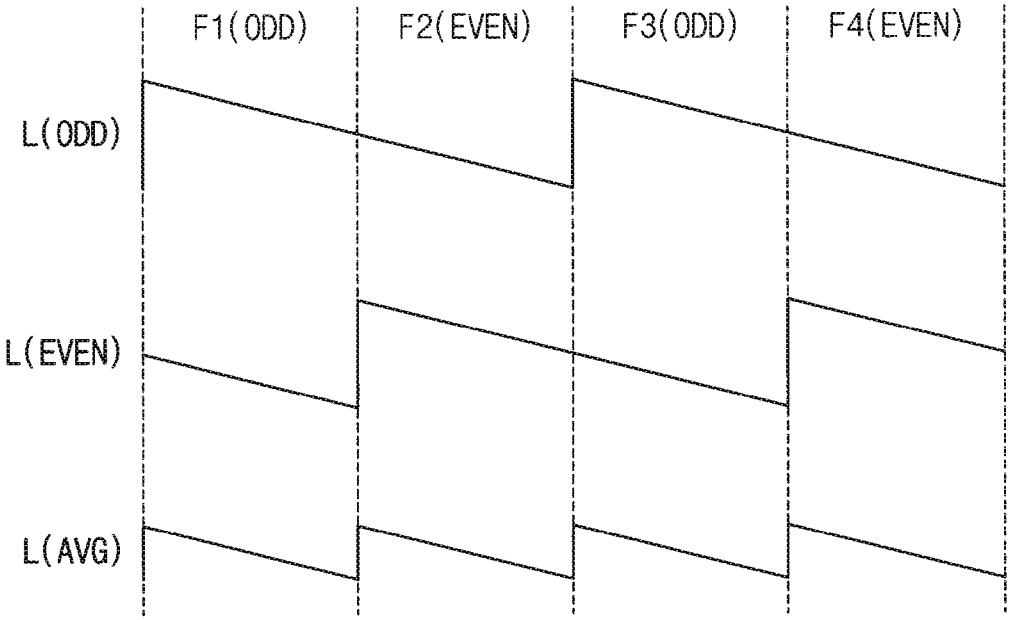
FIG. 7 is a graph illustrating a luminance of a display panel of FIG. 1 in a static image mode.

FIG. 6 is a block diagram illustrating the driving controller 200 of FIG. 1. FIG. 7 is a graph illustrating a luminance of the display panel 100 of FIG. 1 in the static image mode.

Referring to FIGS. 1 to 7, the driving controller 200 may determine the moving image mode and the static image mode according to the input image data IMG. In the moving image mode, the driving controller 200 may drive the gate driver 300 in the moving image driving frequency. In the static image mode, the driving controller 200 may drive the gate driver 300 in the static image driving frequency.

For example, the driving controller 200 may include an image determiner 220 which determines a characteristic of the input image data IMG whether the input image data IMG represent a static image or a moving image and a driving frequency determiner 240 which determines a driving frequency of the gate driver 300 according to the characteristic of the input image data IMG.

In the present example embodiment, the static image driving frequency may be a half of the moving image driving frequency. For example, when the moving image driving frequency is 60 Hz, the static image driving frequency may be 30 Hz. For example, when the moving image driving frequency is 120 Hz, the static image driving frequency may be 60 Hz.

When the input image data IMG represent a static image (in the static image mode), the gate driver 300 may output gate output signals only to odd numbered gate lines during a first frame F1(ODD) and may output gate output signals only to even numbered gate lines during a second frame F2(EVEN). Similarly, when the input image data IMG represent a static image, the gate driver 300 may output gate output signals only to the odd numbered gate lines during a third frame F3(ODD) and may output gate output signals only to the even numbered gate lines during a fourth frame F4(EVEN).

In contrast, when the input image data IMG represent a moving image (in the moving image mode), the gate driver 300 may output gate output signals only to the odd numbered gate lines during a first subframe of a first frame, may output gate output signals only to the even numbered gate lines during a second subframe of the first frame, may output gate output signals only to the odd numbered gate lines during a first subframe of a second frame and may output gate output signals only to the even numbered gate lines during a second subframe of the second frame.

As shown in FIG. 7, in the static image mode, the odd numbered gate lines are scanned during a first duration (e.g. F1 and F3) so that the data voltages VDATA are written in the pixels connected to the odd numbered gate lines. In addition, in the static image mode, the even numbered gate lines are scanned during a second duration (e.g. F2 and F4) so that the data voltages VDATA are written in the pixels connected to the even numbered gate lines.

A user may recognize an average luminance L(AVG) of the luminance L(ODD) of the pixels connected to the odd numbered gate lines and the luminance L(EVEN) of the pixels connected to the even numbered gate lines. Thus, the decrease of the luminance in a relatively low driving frequency may be minimized in the static image mode so that the flicker may be prevented in the static image mode.

Figure 8:
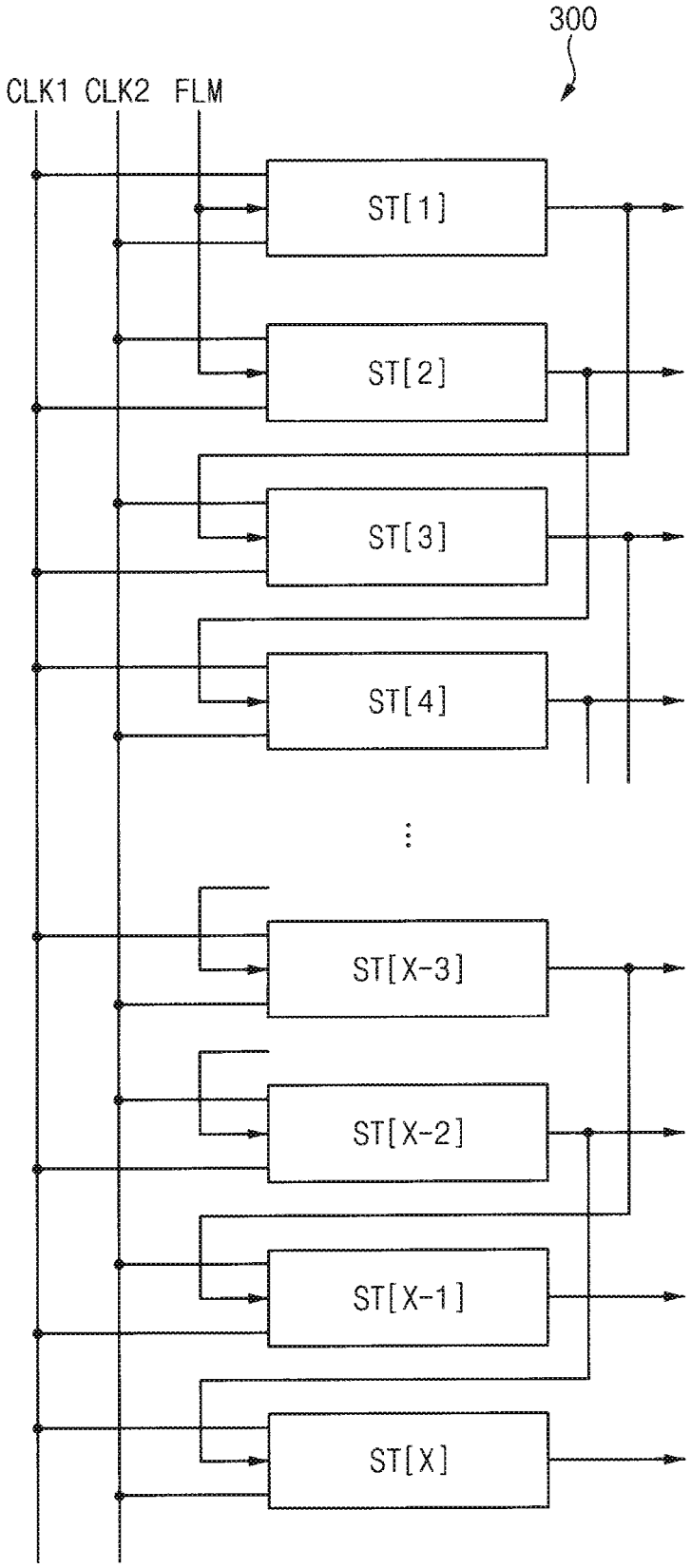
FIG. 8 is a block diagram illustrating a gate driver of FIG. 1.
Figure 9:
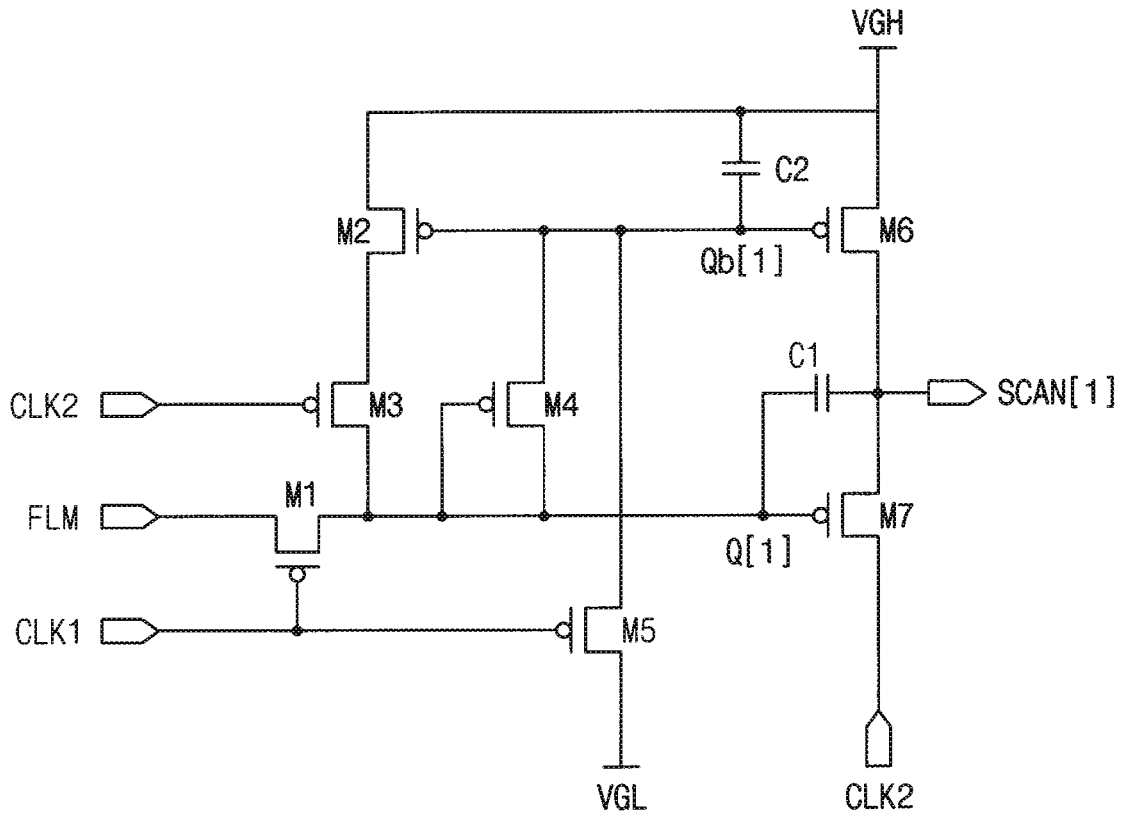
FIG. 9 is a circuit diagram illustrating a first stage of FIG. 8.
Figure 10:
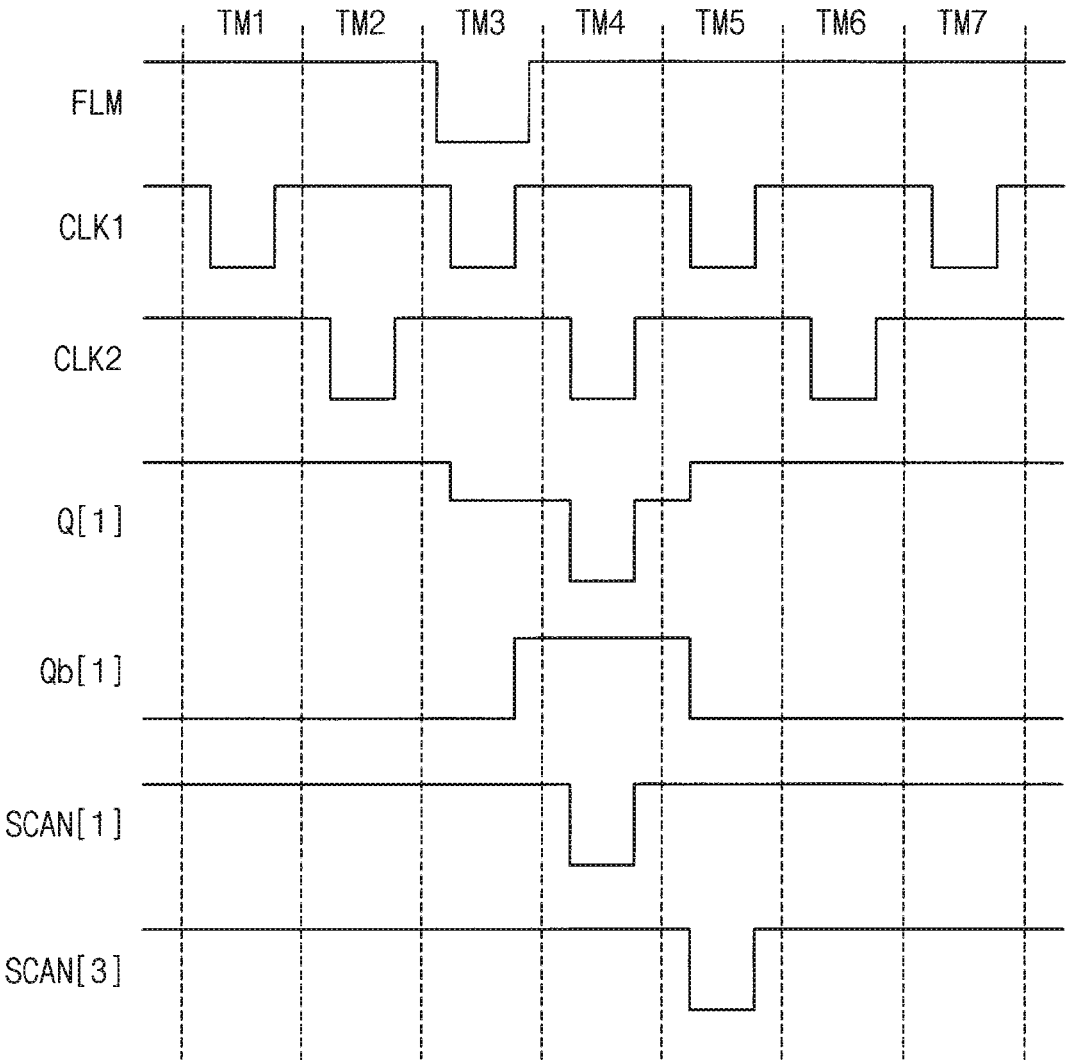
FIG. 10 is a timing diagram illustrating input and output signals of the first stage of FIG. 9.
Figure 11:
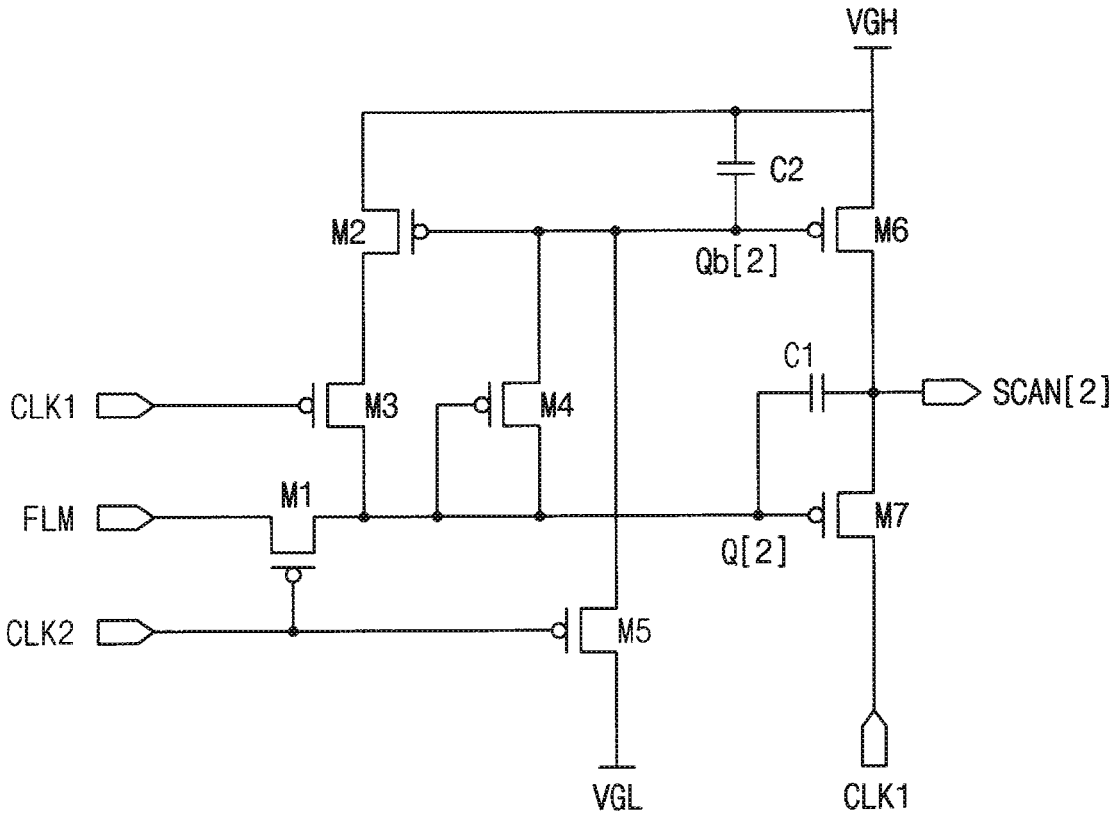
FIG. 11 is a circuit diagram illustrating a second stage of FIG. 8.
Figure 12:
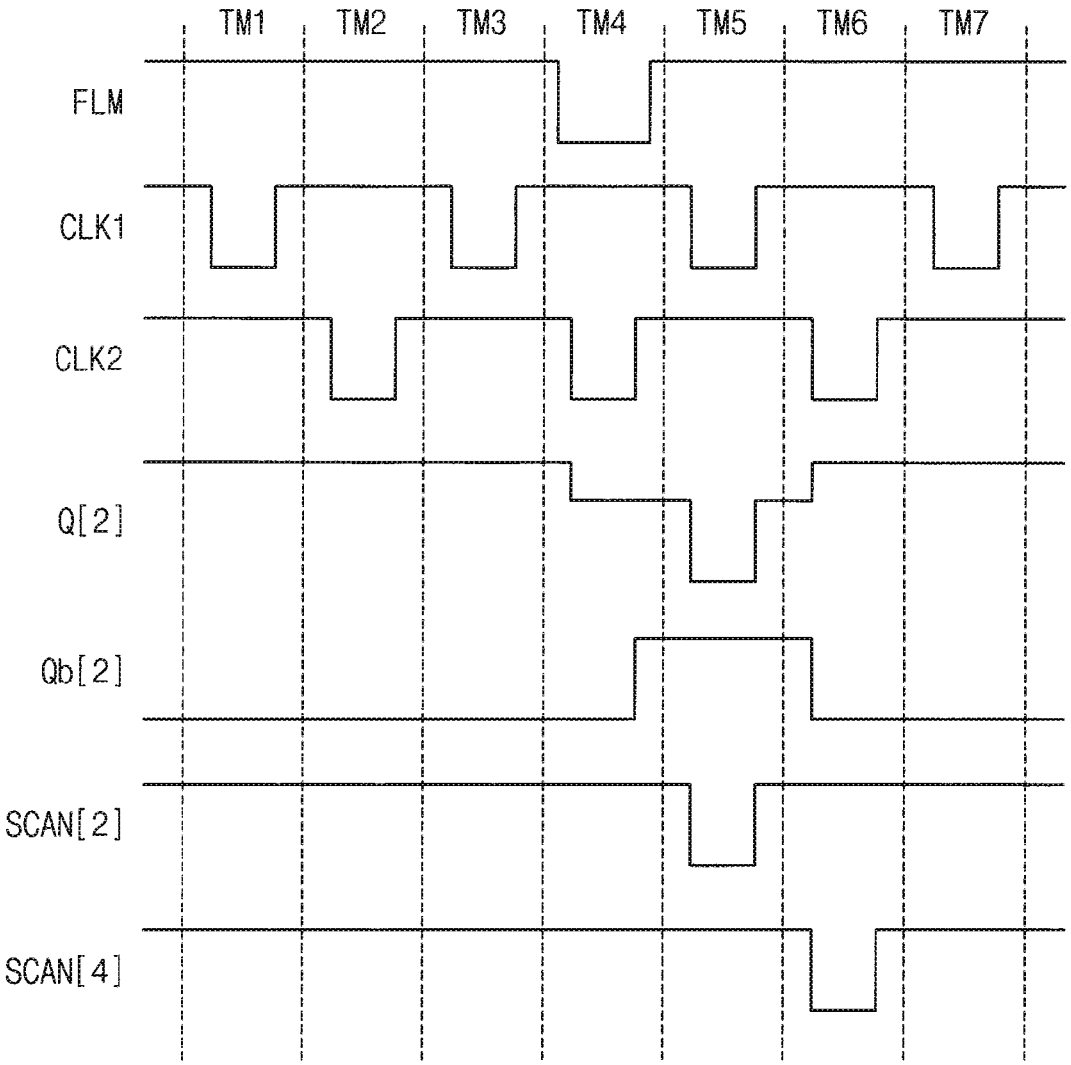
FIG. 12 is a timing diagram illustrating input and output signals of the second stage of FIG. 11.

FIG. 8 is a block diagram illustrating the gate driver 300 of FIG. 1. FIG. 9 is a circuit diagram illustrating a first stage ST[1] of FIG. 8. FIG. 10 is a timing diagram illustrating input and output signals of the first stage ST[1] of FIG. 9. FIG. 11 is a circuit diagram illustrating a second stage ST[2] of FIG. 8. FIG. 12 is a timing diagram illustrating input and output signals of the second stage ST[2] of FIG. 11.

Referring to FIGS. 1 to 12, the gate driver 300 may include a plurality of stages outputting gate output signals. For example, the gate driver 300 may generate the data write gate signals GW and the data initialization gate signals GI using the gate output signals.

To operate the static image mode illustrated in FIG. 7, the gate driver 300 may scan a first group of gate lines (e.g. the odd numbered gate lines) in a first duration (e.g. an odd numbered frame) and may scan a second group of gate lines (e.g. the even numbered gate lines) in a second duration (e.g. an even numbered frame).

The gate driver 300 may include first to X-th stages ST[1] to ST[X]. Herein, X is an integer equal to or greater than eight. X may be equal to or greater than the number of pixel rows of the display panel 100. Although X is an even number in FIG. 8, the present inventive concept may not be limited thereto. Alternatively, X may be an odd number.

The gate driver 300 includes a first stage ST[1], a second stage ST[2], a third stage ST[3], a fourth stage ST[4], . . . , a $(X-3)^{th}$ stage ST[X-3], a $(X-2)^{th}$ stage ST[X-2], a $(X-1)^{th}$ stage ST[X-1], a $X^{th}$ stage ST[X].

The first stage ST[1] may include a first clock terminal receiving a first clock signal CLK1, a second clock terminal receiving a second clock signal CLK2, a carry terminal receiving a vertical start signal FLM and an output terminal outputting a first gate output signal SCAN[1].

The second stage ST[2] may include a first clock terminal receiving the second clock signal CLK2, a second clock terminal receiving the first clock signal CLK1, a carry terminal receiving the vertical start signal FLM and an output terminal outputting a second gate output signal SCAN[2].

The third stage ST[3] may include a first clock terminal receiving the second clock signal CLK2, a second clock terminal receiving the first clock signal CLK1, a carry terminal receiving the first gate output signal SCAN[1] and an output terminal outputting a third gate output signal SCAN[3].

The fourth stage ST[4] may include a first clock terminal receiving the first clock signal CLK1, a second clock terminal receiving the second clock signal CLK2, a carry terminal receiving the second gate output signal SCAN[2] and an output terminal outputting a fourth gate output signal SCAN[4].

As explained above, the carry terminals of the first stage ST[1] and the second stage ST[2] receive the vertical start signal FLM and the carry terminals of the stages ST[3] to ST[X] after the second stage ST[2] receive the gate output signals from the stage before previous stage with respect to the present stages as the carry signals. For example, the carry terminal of the third stage ST[3] receives the first gate output signal SCAN[1] as the carry signal. For example, the carry terminal of the fourth stage ST[4] receives the second gate output signal SCAN[2] as the carry signal. For example, the carry terminal of the X-1-th stage ST[X-1] receives an X-3-th gate output signal SCAN[X-3] as the carry signal. For example, the carry terminal of the X-th stage ST[X] receives an X-2-th gate output signal SCAN[X-2] as the carry signal.

In the present example embodiment, the gate driver 300 may further include a vertical start signal line commonly connected to the carry terminal of the first stage ST[1] and the carry terminal of the second stage ST[2].

The first clock terminals and the second clock terminals of the first stage ST[1] and the fourth stage ST[4] are respectively receive the first clock signal CLK1 and the second clock signal CLK2. In contrast, the first clock terminals and the second clock terminals of the second stage ST[2] and the third stage ST[3] are respectively receive the second clock signal CLK2 and the first clock signal CLK1. The alternate method of applying the first and second clock signals CLK1 and CLK2 which is explained above may be repeated in a unit of four stages in the stages ST[5] to ST[X] after the fourth stage ST[4].

As shown in FIG. 8, the gate driver 300 may further include two gate clock lines outputting the first clock signal CLK1 and the second clock signal CLK2. The gate driver 300 may drive the gate lines by dividing the gate lines into two groups using only two gate clock lines.

As shown in FIG. 9, the first stage ST[1] includes first to seventh switching elements M1 to M7 and a first capacitor Cl and a second capacitor C2.

The first switching element M1 includes a control electrode receiving the first clock signal CLK1, an input electrode receiving the vertical start signal FLM and an output electrode connected to a first control node Q[1]. The first switching element M1 may be a P-type thin film transistor. The control electrode of the first switching element M1 may be a gate electrode, the input electrode of the first switching element M1 may be a source electrode and the output electrode of the first switching element M1 may be a drain electrode.

The second switching element M2 includes a control electrode connected to a second control node Qb[1], an input electrode receiving a first gate power voltage VGH and an output electrode connected to an input electrode of the third switching element M3. The second switching element M2 may be a P-type thin film transistor. The control electrode of the second switching element M2 may be a gate electrode, the input electrode of the second switching element M2 may be a source electrode and the output electrode of the second switching element M2 may be a drain electrode.

The third switching element M3 includes a control electrode receiving the second clock signal CLK2, the input electrode connected to the output electrode of the second switching element M2 and an output electrode connected to the first control node Q[1]. The third switching element M3 may be a P-type thin film transistor. The control electrode of the third switching element M3 may be a gate electrode, the input electrode of the third switching element M3 may be a source electrode and the output electrode of the third switching element M3 may be a drain electrode.

The fourth switching element M4 includes a control electrode connected to the first control node Q[1], an input electrode connected to the second control node Qb[1] and an output electrode connected to the first control node Q[1]. The fourth switching element M4 may be a P-type thin film transistor. The control electrode of the fourth switching element M4 may be a gate electrode, the input electrode of the fourth switching element M4 may be a source electrode and the output electrode of the fourth switching element M4 may be a drain electrode.

The fifth switching element M5 includes a control electrode receiving the first clock signal CLK1, an input electrode receiving a second gate power voltage VGL lower than the first gate power voltage VGH and an output electrode connected to the second control node Qb[1]. The fifth switching element M5 may be a P-type thin film transistor. The control electrode of the fifth switching element M5 may be a gate electrode, the input electrode of the fifth switching element M5 may be a source electrode and the output electrode of the fifth switching element M5 may be a drain electrode.

The sixth switching element M6 includes a control electrode connected to the second control node Qb[1], an input electrode receiving the first gate power voltage VGH and an output electrode connected to an output terminal SCAN[1]. The output terminal SCAN[1] may be a node outputting the scan signal of the present stage ST[1]. The sixth switching element M6 may be a P-type thin film transistor. The control electrode of the sixth switching element M6 may be a gate electrode, the input electrode of the sixth switching element M6 may be a source electrode and the output electrode of the sixth switching element M6 may be a drain electrode.

The seventh switching element M7 includes a control electrode connected to the first control node Q[1], an input electrode receiving the second clock signal CLK2 and an output electrode connected to the output terminal SCAN[1]. The seventh switching element M7 may be a P-type thin film transistor. The control electrode of the seventh switching element M7 may be a gate electrode, the input electrode of the seventh switching element M7 may be a source electrode and the output electrode of the seventh switching element M7 may be a drain electrode.

The first capacitor C1 includes a first electrode connected to the output terminal SCAN[1] and a second electrode connected to the first control node Q[1]. The second capacitor C2 includes a first electrode receiving the first gate power voltage VGH and a second electrode connected to the second control node Qb[1].

As shown in FIG. 10, the first clock signal CLK1 may have an active level in first, third, fifth, seventh driving durations TM1, TM3, TM5 and TM7. The second clock signal CLK2 may have an active level in second, fourth and sixth driving durations TM2, TM4 and TM6.

During the third driving duration TM3, the first switching element M1 is turned on in response to the first clock signal CLK1 having an active level and the vertical start signal FLM has an active level so that the voltage of the first control node Q[1] may have a first low level corresponding to the vertical start signal FLM.

During the third driving duration TM3, the voltage of the second control node Qb[1] may have a low level due to the fourth switching element M4 and the fifth switching element M5 which are turned on.

During the fourth driving duration TM4, the voltage of the first control node Q[1] may be charge-boosted by the third switching element M3 and the first capacitor Cl so that the voltage of the first control node Q[1] may have a second low level.

During the fourth driving duration TM4, the seventh switching element M7 is turned on in response to the voltage of the first control node Q[1] and the output terminal SCAN[1] output a pulse of the second clock signal CLK2 as the scan signal SCAN[1] of the first stage.

During the fifth driving duration TM5, the voltage of the first control node Q[1] increases back to a high level, the scan signal SCAN[1] of the first stage also increases back to a high level.

The voltage of the second control node Qb[1] may increase to a high level at an end portion of the third driving duration TM3 corresponding to the rising edge of the vertical start signal FLM.

The voltage of the second control node Qb[1] may maintain the high level during the fourth driving duration TM4. The voltage of the second control node Qb[1] decrease to a low level at a falling edge of the first clock signal CLK1 in the fifth driving duration TM5.

The third stage ST[3] receives the gate output signal SCAN[1] of the first stage ST[1] as the carry signal. The third stage ST[3] outputs a pulse of the gate output signal later than the pulse of the gate output signal of the first stage ST[1] by one driving duration (e.g. in TM5).

As shown in FIG. 11, the second stage ST[2] includes first to seventh switching elements M1 to M7 and a first capacitor Cl and a second capacitor C2.

The first switching element M1 includes a control electrode receiving the second clock signal CLK2, an input electrode receiving the vertical start signal FLM and an output electrode connected to a first control node Q[2]. The first switching element M1 may be a P-type thin film transistor. The control electrode of the first switching element M1 may be a gate electrode, the input electrode of the first switching element M1 may be a source electrode and the output electrode of the first switching element M1 may be a drain electrode.

The second switching element M2 includes a control electrode connected to a second control node Qb[2], an input electrode receiving a first gate power voltage VGH and an output electrode connected to an input electrode of the third switching element M3. The second switching element M2 may be a P-type thin film transistor. The control electrode of the second switching element M2 may be a gate electrode, the input electrode of the second switching element M2 may be a source electrode and the output electrode of the second switching element M2 may be a drain electrode.

The third switching element M3 includes a control electrode receiving the first clock signal CLK1, the input electrode connected to the output electrode of the second switching element M2 and an output electrode connected to the first control node Q[2]. The third switching element M3 may be a P-type thin film transistor. The control electrode of the third switching element M3 may be a gate electrode, the input electrode of the third switching element M3 may be a source electrode and the output electrode of the third switching element M3 may be a drain electrode.

The fourth switching element M4 includes a control electrode connected to the first control node Q[2], an input electrode connected to the second control node Qb[2] and an output electrode connected to the first control node Q[2]. The fourth switching element M4 may be a P-type thin film transistor. The control electrode of the fourth switching element M4 may be a gate electrode, the input electrode of the fourth switching element M4 may be a source electrode and the output electrode of the fourth switching element M4 may be a drain electrode.

The fifth switching element M5 includes a control electrode receiving the second clock signal CLK2, an input electrode receiving the second gate power voltage VGL and an output electrode connected to the second control node Qb[2]. The fifth switching element M5 may be a P-type thin film transistor. The control electrode of the fifth switching element M5 may be a gate electrode, the input electrode of the fifth switching element M5 may be a source electrode and the output electrode of the fifth switching element M5 may be a drain electrode.

The sixth switching element M6 includes a control electrode connected to the second control node Qb[2], an input electrode receiving the first gate power voltage VGH and an output electrode connected to an output terminal SCAN[2]. The output terminal SCAN[2] may be a node outputting the scan signal of the present stage ST[2]. The sixth switching element M6 may be a P-type thin film transistor. The control electrode of the sixth switching element M6 may be a gate electrode, the input electrode of the sixth switching element M6 may be a source electrode and the output electrode of the sixth switching element M6 may be a drain electrode.

The seventh switching element M7 includes a control electrode connected to the first control node Q[2], an input electrode receiving the first clock signal CLK1 and an output electrode connected to the output terminal SCAN[2]. The seventh switching element M7 may be a P-type thin film transistor. The control electrode of the seventh switching element M7 may be a gate electrode, the input electrode of the seventh switching element M7 may be a source electrode and the output electrode of the seventh switching element M7 may be a drain electrode.

The first capacitor C1 includes a first electrode connected to the output terminal SCAN[2] and a second electrode connected to the first control node Q[2]. The second capacitor C2 includes a first electrode receiving the first gate power voltage VGH and a second electrode connected to the second control node Qb[2].

As shown in FIG. 12, the first clock signal CLK1 may have an active level in first, third, fifth, seventh driving durations TM1, TM3, TM5 and TM7. The second clock signal CLK2 may have an active level in second, fourth and sixth driving durations TM2, TM4 and TM6.

As shown in FIG. 12, the vertical start signal FLM may be activated during the fourth driving duration TM4 so that the signal of the first control node Q[2] and the signal of the second control node Qb[2] may be delayed by one driving duration compared to FIG. 10. Similarly, the gate output signal SCAN[2] of the second stage ST[2] may be delayed by one driving duration compared to the gate output signal SCAN[1] of the first stage ST[1] in FIG. 10 and the gate output signal SCAN[4] of the fourth stage ST[4] may be delayed by one driving duration compared to the gate output signal SCAN[3] of the third stage ST[3] in FIG. 10.

As shown in FIG. 10, the first stage ST[1] may output the first gate output signal SCAN[1] in response to the vertical start signal FLM having an active period overlapped with an active period of the first clock signal CLK1. As shown in FIG. 12, the second stage ST[2] may output the second gate output signal SCAN[2] in response to the vertical start signal FLM having an active period overlapped with an active period of the second clock signal CLK2.

Figure 13:
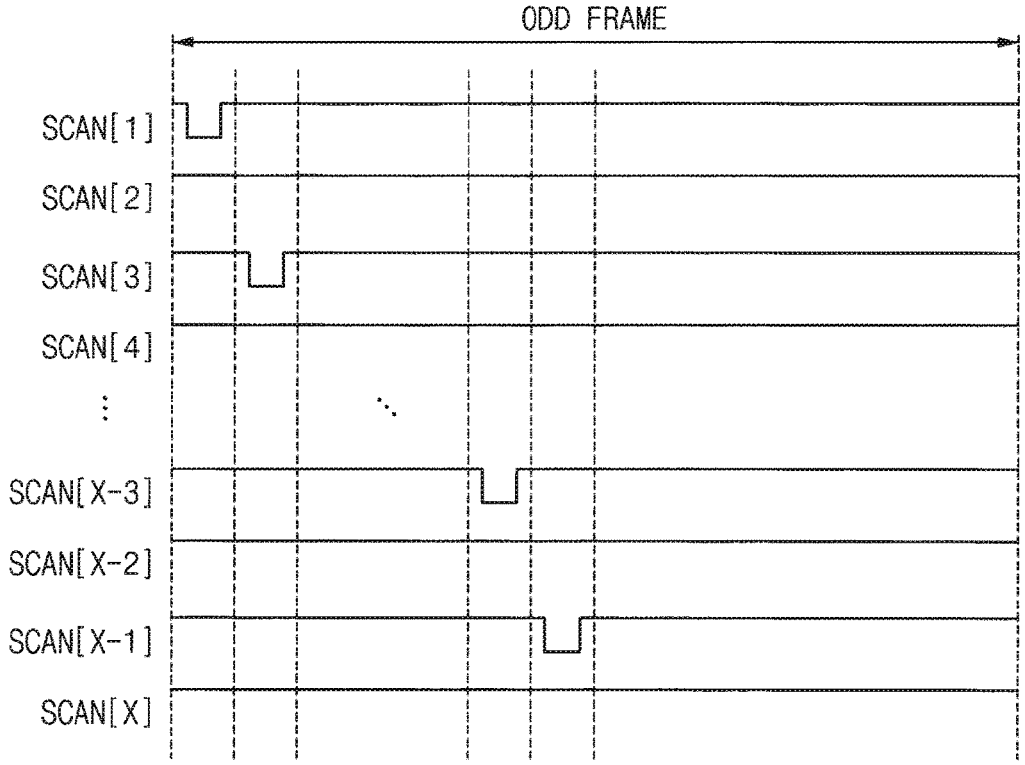
FIG. 13 is a timing diagram illustrating an output signal of the gate driver of FIG. 1 in a first frame in the static image mode.
Figure 14:
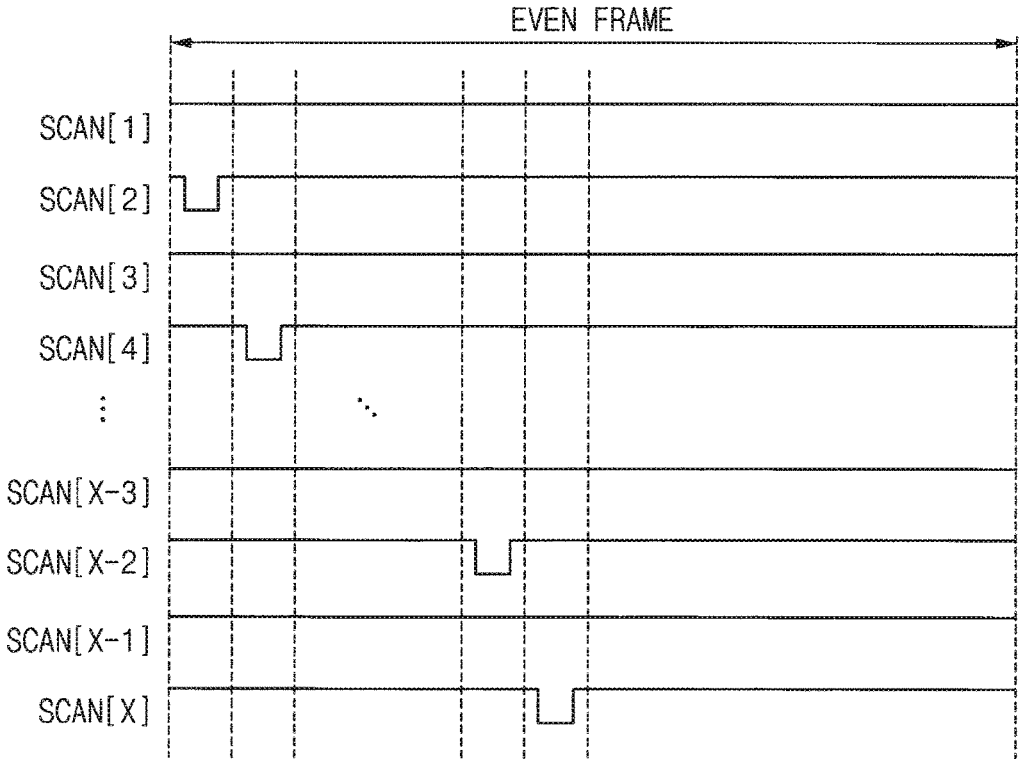
FIG. 14 is a timing diagram illustrating an output signal of the gate driver of FIG. 1 in a second frame in the static image mode.
Figure 15:
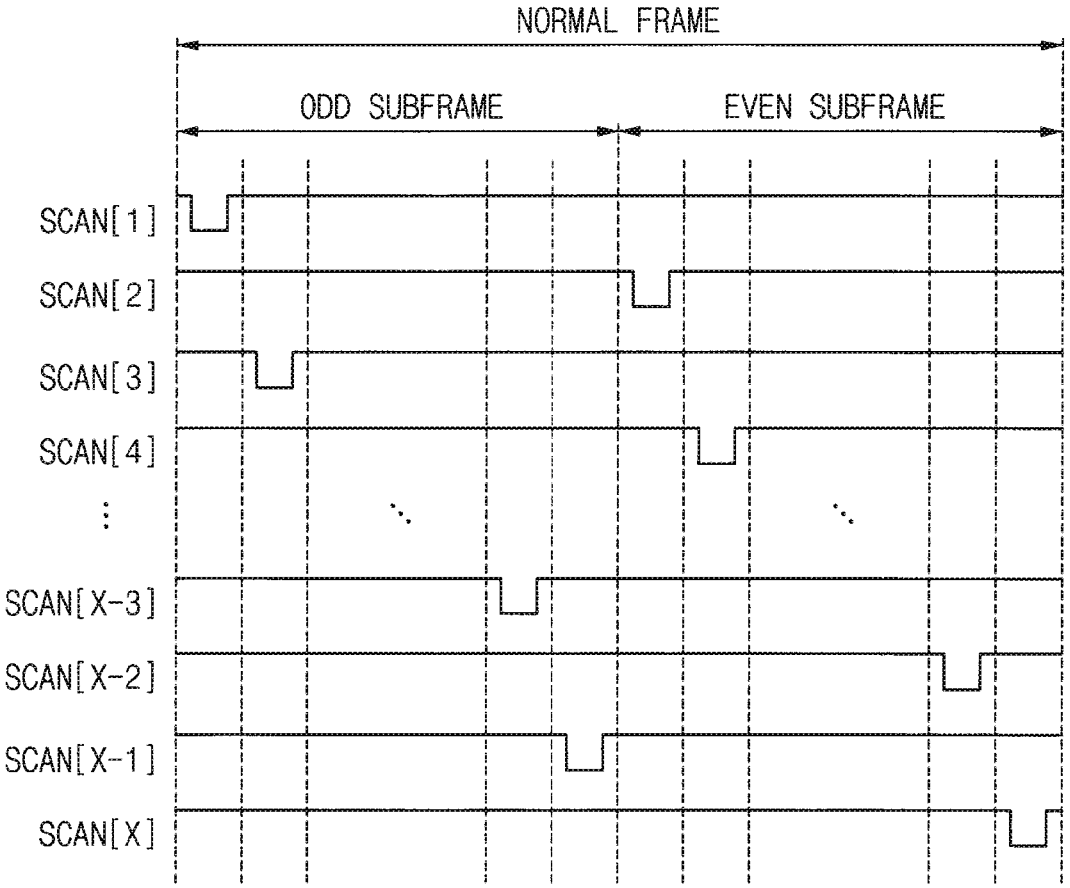
FIG. 15 is a timing diagram illustrating an output signal of the gate driver of FIG. 1 in a first frame in a moving image mode.

FIG. 13 is a timing diagram illustrating an output signal of the gate driver 300 of FIG. 1 in a first frame in the static image mode. FIG. 14 is a timing diagram illustrating an output signal of the gate driver 300 of FIG. 1 in a second frame in the static image mode. FIG. 15 is a timing diagram illustrating an output signal of the gate driver 300 of FIG. 1 in a first frame in the moving image mode.

As shown in FIG. 13, odd numbered gate output signals SCAN[1], SCAN[3], . . . , SCAN[X-3] and SCAN[X-1] may be outputted to the odd numbered gate lines and the gate output signals may not be outputted to the even numbered gate lines in the first frame ODD FRAME in the static image mode.

As shown in FIG. 14, even numbered gate output signals SCAN[2], SCAN[4], . . . , SCAN[X-2] and SCAN[X] may be outputted to the even numbered gate lines and the gate output signals may not be outputted to the odd numbered gate lines in the second frame EVEN FRAME in the static image mode.

As shown in FIG. 15, the gate driver 300 may output the gate output signals SCAN[1], SCAN[3], . . . , SCAN[X-3] and SCAN[X-1] corresponding to the odd numbered gate lines in a first subframe ODD SUBFRAME of a first frame NORMAL FRAME and may output the gate output signals SCAN[2], SCAN[4], . . . , SCAN[X-2] and SCAN[X] corresponding to the even numbered gate lines in a second subframe EVEN SUBFRAME of the first frame NORMAL FRAME.

According to the present example embodiment, the driving controller 200 drives the display panel 100 in the moving image driving frequency in the moving image mode, and the driving controller 200 drives the display panel 100 in the static image driving frequency in the static image mode. Thus, the power consumption of the display apparatus may be reduced.

In addition, in the static image mode, the gate driver 300 scans the first group of the gate lines in a first duration and the second group of the gate lines in a second duration so that the flicker due to the current leakage of the pixel may be prevented.

In addition, in the static image mode, the gate lines are driven into two groups using only two gate clock lines so that the dead space of the display apparatus may be reduced.

Figure 16:
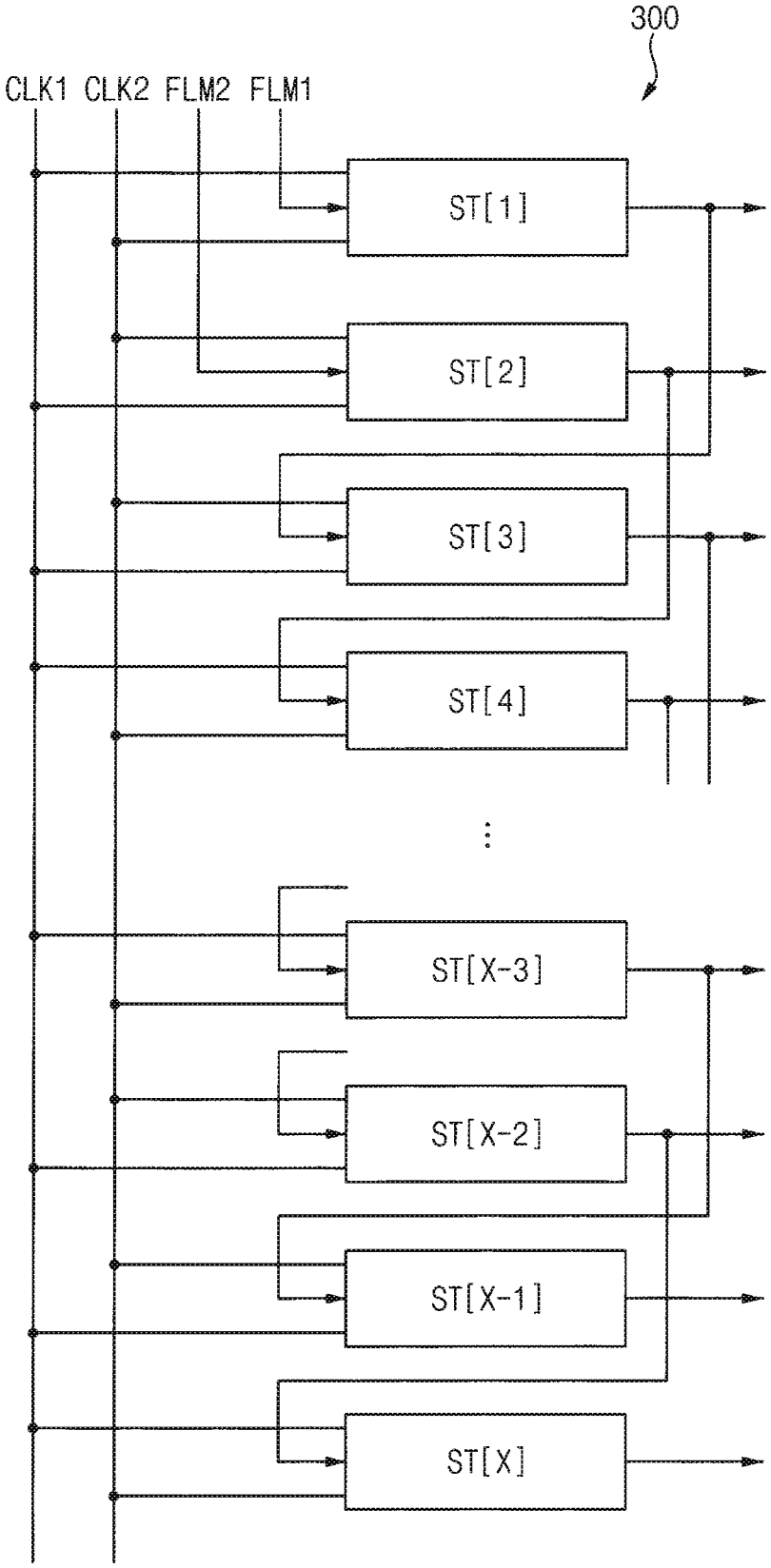
FIG. 16 is a block diagram illustrating a gate driver of a display apparatus according to an example embodiment of the present inventive concept.

FIG. 16 is a block diagram illustrating a gate driver of a display apparatus according to an example embodiment of the present inventive concept.

The gate driver and the display apparatus according to the present example embodiment is substantially the same as the gate driver and the display apparatus of the previous example embodiment explained referring to FIGS. 1 to 15 except for the vertical start signal and the vertical start signal line. Thus, the same reference numerals will be used to refer to the same or like parts as those described in the previous example embodiment of FIGS. 1 to 15 and any repetitive explanation concerning the above elements will be omitted.

Referring to FIGS. 1 to 7 and 9 to 16, the gate driver 300 may include a plurality of stages outputting gate output signals.

The gate driver 300 may include first to X-th stages ST[1] to ST[X]. Herein, X is an integer equal to or greater than eight. X may be equal to or greater than the number of pixel rows of the display panel 100. Although X is an even number in FIG. 16, the present inventive concept may not be limited thereto. Alternatively, X may be an odd number.

In the present example embodiment, the first stage ST[1] may output the first gate output signal SCAN[1] in response to a first vertical start signal FLM1 having an active period overlapped with an active period of the first clock signal CLK1. The second stage ST[2] may output the second gate output signal SCAN[2] in response to a second vertical start signal FLM2 having an active period overlapped with an active period of the second clock signal CLK2.

The gate driver 300 may further include a first vertical start signal line connected to the carry terminal of the first stage ST[1] and outputs the first vertical start signal FLM1 to the carry terminal of the first stage ST[1] and a second vertical start signal line connected to the carry terminal of the second stage ST[2] and outputs the second vertical start signal FLM2 to the carry terminal of the second stage ST[2].

According to the present example embodiment, the driving controller 200 drives the display panel 100 in the moving image driving frequency in the moving image mode, and the driving controller 200 drives the display panel 100 in the static image driving frequency in the static image mode. Thus, the power consumption of the display apparatus may be reduced.

In addition, in the static image mode, the gate driver 300 scans the first group of the gate lines in a first duration and the second group of the gate lines in a second duration so that the flicker due to the current leakage of the pixel may be prevented.

In addition, in the static image mode, the gate lines are driven into two groups using only two gate clock lines so that the dead space of the display apparatus may be reduced.

Figure 17:
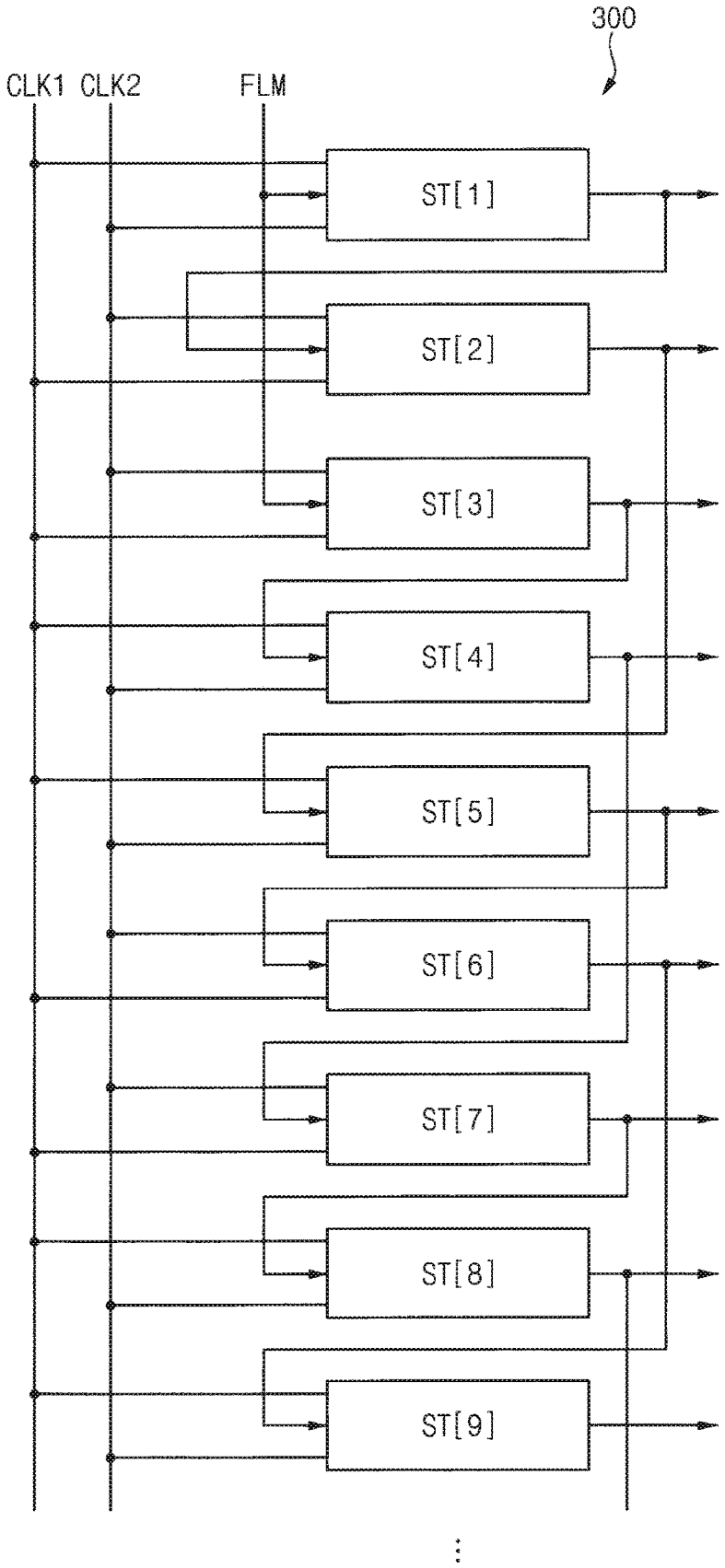
FIG. 17 is a block diagram illustrating a gate driver of a display apparatus according to an example embodiment of the present inventive concept.

FIG. 17 is a block diagram illustrating a gate driver of a display apparatus according to an example embodiment of the present inventive concept.

The gate driver and the display apparatus according to the present example embodiment is substantially the same as the gate driver and the display apparatus of the previous example embodiment explained referring to FIGS. 1 to 15 except for the stage of the gate driver. Thus, the same reference numerals will be used to refer to the same or like parts as those described in the previous example embodiment of FIGS. 1 to 15 and any repetitive explanation concerning the above elements will be omitted.

Referring to FIGS. 1 to 6 and 9 to 15 and 17, the gate driver 300 may include a plurality of stages outputting gate output signals.

The gate driver 300 may include first to X-th stages ST[1] to ST[X]. X may be equal to or greater than the number of pixel rows of the display panel 100.

FIG. 17 illustrates first to ninth stages ST[1] to ST[9] to explain the operation of the gate driver 300 of the present example embodiment.

The gate driver 300 may include a first stage ST[1] including a first clock terminal receiving a first clock signal CLK1, a second clock terminal receiving a second clock signal CLK2, a carry terminal receiving a vertical start signal FLM and an output terminal outputting a first gate output signal SCAN[1], a second stage ST[2] including a first clock terminal receiving the second clock signal CLK2, a second clock terminal receiving the first clock signal CLK1, a carry terminal receiving the first gate output signal SCAN[1] and an output terminal outputting a second gate output signal SCAN[2], a third stage ST[3] including a first clock terminal receiving the second clock signal CLK2, a second clock terminal receiving the first clock signal CLK1, a carry terminal receiving the vertical start signal FLM and an output terminal outputting a third gate output signal SCAN[3], a fourth stage ST[4] including a first clock terminal receiving the first clock signal CLK1, a second clock terminal receiving the second clock signal CLK2, a carry terminal receiving the third gate output signal SCAN [3] and an output terminal outputting a fourth gate output signal SCAN[4], a fifth stage ST[5] including a first clock terminal receiving the first clock signal CLK1, a second clock terminal receiving the second clock signal CLK2, a carry terminal receiving the second gate output signal SCAN[2] and an output terminal outputting a fifth gate output signal SCAN[5], a sixth stage ST[6] including a first clock terminal receiving the second clock signal CLK2, a second clock terminal receiving the first clock signal CLK1, a carry terminal receiving the fifth gate output signal SCAN[5] and an output terminal outputting a sixth gate output signal SCAN[6], a seventh stage ST[7] including a first clock terminal receiving the second clock signal CLK2, a second clock terminal receiving the first clock signal CLK1, a carry terminal receiving the fourth gate output signal SCAN[4] and an output terminal outputting a seventh gate output signal SCAN[7] and an eight stage ST[8] including a first clock terminal receiving the first clock signal CLK1, a second clock terminal receiving the second clock signal CLK2, a carry terminal receiving the seventh gate output signal SCAN[7] and an output terminal outputting an eighth gate output signal SCAN[8].

In the present example embodiment, when the input image data IMG represents a moving image, the gate driver 300 may be driven in a first driving frequency. When the input image data IMG represents a static image, the gate driver 300 may be driven in a second driving frequency which is a half of the first driving frequency.

When the input image data represent a static image, the gate driver 300 may output the gate output signals corresponding to 4N-3-th gate lines and 4N-2-th gate lines (e.g. 1, 2, 5, 6, . . . ) in a first frame and the gate output signals corresponding to 4N-1-th gate lines and 4N-th gate lines (e.g. 3, 4, 7, 8, . . . ) in a second frame.

When the input image data represent a moving image, the gate driver 300 may output the gate output signals corresponding to 4N-3-th gate lines and 4N-2-th gate lines (e.g. 1, 2, 5, 6, . . . ) in a first subframe of a first frame, the gate output signals corresponding to 4N-1-th gate lines and 4N-th gate lines (e.g. 3, 4, 7, 8, . . . ) in a second subframe of the first frame, the gate output signals corresponding to 4N-3-th gate lines and 4N-2-th gate lines (e.g. 1, 2, 5, 6, . . . ) in a first subframe of a second frame and the gate output signals corresponding to 4N-1-th gate lines and 4N-th gate lines (e.g. 3, 4, 7, 8, . . . ) in a second subframe of the second frame.

According to the present example embodiment, the driving controller 200 drives the display panel 100 in the moving image driving frequency in the moving image mode, and the driving controller 200 drives the display panel 100 in the static image driving frequency in the static image mode. Thus, the power consumption of the display apparatus may be reduced.

In addition, in the static image mode, the gate driver 300 scans the first group of the gate lines in a first duration and the second group of the gate lines in a second duration so that the flicker due to the current leakage of the pixel may be prevented.

In addition, in the static image mode, the gate lines are driven into two groups using only two gate clock lines so that the dead space of the display apparatus may be reduced.

According to the present inventive concept as explained above, the power consumption may be reduced by the low frequency driving method, the display quality of the display panel may be enhanced by preventing the flicker and the dead space may be reduced by reducing the number of the clock lines.

The foregoing is illustrative of the present inventive concept and is not to be construed as limiting thereof. Although a few example embodiments of the present inventive concept have been described, those skilled in the art will readily appreciate that many modifications are possible in the example embodiments without materially departing from the novel teachings and advantages of the present inventive concept. Accordingly, all such modifications are intended to be included within the scope of the present inventive concept as defined in the claims. In the claims, means-plus-function clauses are intended to cover the structures described herein as performing the recited function and not only structural equivalents but also equivalent structures. Therefore, it is to be understood that the foregoing is illustrative of the present inventive concept and is not to be construed as limited to the specific example embodiments disclosed, and that modifications to the disclosed example embodiments, as well as other example embodiments, are intended to be included within the scope of the appended claims. The present inventive concept is defined by the following claims, with equivalents of the claims to be included therein.

What is claimed is:

1. A gate driver comprising:

a first stage comprising a first clock terminal configured to receive a first clock signal, a second clock terminal configured to receive a second clock signal, a carry terminal configured to receive a vertical start signal and an output terminal configured to output a first gate output signal;

a second stage comprising a first clock terminal configured to receive the second clock signal, a second clock terminal configured to receive the first clock signal, a carry terminal configured to receive the vertical start signal and an output terminal configured to output a second gate output signal;

a third stage comprising a first clock terminal configured to receive the second clock signal, a second clock terminal configured to receive the first clock signal, a carry terminal configured to receive the first gate output signal and an output terminal configured to output a third gate output signal; and a fourth stage comprising a first clock terminal configured to receive the first clock signal, a second clock terminal configured to receive the second clock signal, a carry terminal configured to receive the second gate output signal and an output terminal configured to output a fourth gate output signal.

2. The gate driver of claim 1, wherein when input image data represent a moving image, the gate driver is driven in a first driving frequency, and wherein when the input image data represent a static image, the gate driver is driven in a second driving frequency which is a half of the first driving frequency.

3. The gate driver of claim 2, wherein, when the input image data represent the static image, the gate driver is configured to output gate output signals only to odd numbered gate lines in a first frame and gate output signals only to even numbered gate lines in a second frame.

4. The gate driver of claim 3, wherein, when the input image data represent the moving image, the gate driver is configured to output gate output signals only to the odd numbered gate lines in a first subframe of a first frame, gate output signals only to the even numbered gate lines in a second subframe of the first frame, gate output signals only to the odd numbered gate lines in a first subframe of a second frame and gate output signals only to the even numbered gate lines in a second subframe of the second frame.

5. The gate driver of claim 1, wherein the first stage comprises:

a first switching element comprising a control electrode configured to receive the first clock signal, an input electrode configured to receive the vertical start signal and an output electrode connected to a first control node of the first stage;

a second switching element comprising a control electrode connected to a second control node of the first stage, an input electrode configured to receive a first gate power voltage and an output electrode;

a third switching element comprising a control electrode configured to receive the second clock signal, an input electrode connected to the output electrode of the second switching element of the first stage and an output electrode connected to the first control node of the first stage;

a fourth switching element comprising a control electrode connected to the first control node of the first stage, an input electrode connected to the second control node of the first stage and an output electrode connected to the first control node of the first stage;

a fifth switching element comprising a control electrode configured to receive the first clock signal, an input electrode configured to receive a second gate power voltage different from the first gate power voltage and an output electrode connected to the second control node of the first stage;

a sixth switching element comprising a control electrode connected to the second control node of the first stage, an input electrode configured to receive the first gate power voltage and an output electrode connected to the output terminal of the first stage; and a seventh switching element comprising a control electrode connected to the first control node of the first stage, an input electrode configured to receive the second clock signal and an output electrode connected to the output terminal of the first stage.

6. The gate driver of claim 5, wherein the second stage comprises:

a first switching element comprising a control electrode configured to receive the second clock signal, an input electrode configured to receive the vertical start signal and an output electrode connected to a first control node of the second stage;

a second switching element comprising a control electrode connected to a second control node of the second stage, an input electrode configured to receive the first gate power voltage and an output electrode;

a third switching element comprising a control electrode configured to receive the first clock signal, an input electrode connected to the output electrode of the second switching element of the second stage and an output electrode connected to the first control node of the second stage;

a fourth switching element comprising a control electrode connected to the first control node of the second stage, an input electrode connected to the second control node of the second stage and an output electrode connected to the first control node of the second stage;

a fifth switching element comprising a control electrode configured to receive the second clock signal, an input electrode configured to receive the second gate power voltage and an output electrode connected to the second control node of the second stage;

a sixth switching element comprising a control electrode connected to the second control node of the second stage, an input electrode configured to receive the first gate power voltage and an output electrode connected to the output terminal of the second stage; and a seventh switching element comprising a control electrode connected to the first control node of the second stage, an input electrode configured to receive the first clock signal and an output electrode connected to the output terminal of the second stage.

7. The gate driver of claim 1, wherein the first stage is configured to output the first gate output signal in response to the vertical start signal having an active period overlapped with an active period of the first clock signal, and wherein the second stage is configured to output the second gate output signal in response to the vertical start signal having an active period overlapped with an active period of the second clock signal.

8. The gate driver of claim 1, further comprising a vertical start signal line commonly connected to the carry terminal of the first stage and the carry terminal of the second stage.

9. The gate driver of claim 1, further comprising a first vertical start signal line connected to the carry terminal of the first stage and a second vertical start signal line connected to the carry terminal of the second stage.

10. A gate driver comprising:

a first stage comprising a first clock terminal configured to receive a first clock signal, a second clock terminal configured to receive a second clock signal, a carry terminal configured to receive a vertical start signal and an output terminal configured to output a first gate output signal;

a second stage comprising a first clock terminal configured to receive the second clock signal, a second clock terminal configured to receive the first clock signal, a carry terminal configured to receive the first gate output signal and an output terminal configured to output a second gate output signal;

a third stage comprising a first clock terminal configured to receive the second clock signal, a second clock terminal configured to receive the first clock signal, a carry terminal configured to receive the vertical start signal and an output terminal configured to output a third gate output signal;

a fourth stage comprising a first clock terminal configured to receive the first clock signal, a second clock terminal configured to receive the second clock signal, a carry terminal configured to receive the third gate output signal and an output terminal configured to output a fourth gate output signal;

a fifth stage comprising a first clock terminal configured to receive the first clock signal, a second clock terminal configured to receive the second clock signal, a carry terminal configured to receive the second gate output signal and an output terminal configured to output a fifth gate output signal;

a sixth stage comprising a first clock terminal configured to receive the second clock signal, a second clock terminal configured to receive the first clock signal, a carry terminal configured to receive the fifth gate output signal and an output terminal configured to output a sixth gate output signal;

a seventh stage comprising a first clock terminal configured to receive the second clock signal, a second clock terminal configured to receive the first clock signal, a carry terminal configured to receive the fourth gate output signal and an output terminal configured to output a seventh gate output signal; and an eight stage comprising a first clock terminal configured to receive the first clock signal, a second clock terminal configured to receive the second clock signal, a carry terminal configured to receive the seventh gate output signal and an output terminal configured to output an eighth gate output signal.

11. The gate driver of claim 10, wherein when input image data represent a moving image, the gate driver is driven in a first driving frequency, and wherein when the input image data represent a static image, the gate driver is driven in a second driving frequency which is a half of the first driving frequency.

12. The gate driver of claim 11, wherein, when the input image data represent the static image, the gate driver is configured to output gate output signals only to 4N-3-th gate lines and 4N-2-th gate lines in a first frame and gate output signals only to 4N-1-th gate lines and 4N-th gate lines in a second frame, where N is a positive integer.

13. The gate driver of claim 12, wherein, when the input image data represent the moving image, the gate driver is configured to output gate output signals only to the 4N-3-th gate lines and the 4N-2-th gate lines in a first subframe of a first frame, gate output signals only to the 4N-1-th gate lines and the 4N-th gate lines in a second subframe of the first frame, gate output signals only to the 4N-3-th gate lines and the 4N-2-th gate lines in a first subframe of a second frame and gate output signals only to the 4N-1-th gate lines and the 4N-th gate lines in a second subframe of the second frame.

14. A display apparatus comprising:

a display panel comprising a plurality of pixels and configured to display an image based on input image data;

a gate driver configured to output a plurality of gate signals to a plurality of gate lines of the display panel;

a data driver configured to output a plurality of data voltages to a plurality of data lines of the display panel; and a driving controller configured to determine a driving mode of the input image data, wherein the gate driver comprises:

a first stage comprising a first clock terminal configured to receive a first clock signal, a second clock terminal configured to receive a second clock signal, a carry terminal configured to receive a vertical start signal and an output terminal configured to output a first gate output signal;

a second stage comprising a first clock terminal configured to receive the second clock signal, a second clock terminal configured to receive the first clock signal, a carry terminal configured to receive the vertical start signal and an output terminal configured to output a second gate output signal;

a third stage comprising a first clock terminal configured to receive the second clock signal, a second clock terminal configured to receive the first clock signal, a carry terminal configured to receive the first gate output signal and an output terminal configured to output a third gate output signal; and a fourth stage comprising a first clock terminal configured to receive the first clock signal, a second clock terminal configured to receive the second clock signal, a carry terminal configured to receive the second gate output signal and an output terminal configured to output a fourth gate output signal.

15. The display apparatus of claim 14, wherein when the input image data represent a moving image, the gate driver is driven in a first driving frequency, and wherein when the input image data represent a static image, the gate driver is driven in a second driving frequency which is a half of the first driving frequency.

16. The display apparatus of claim 15, wherein, when the input image data represent the static image, the gate driver is configured to output gate output signals only to odd numbered gate lines in a first frame and gate output signals only to even numbered gate lines in a second frame.

17. The display apparatus of claim 16, wherein, when the input image data represent the moving image, the gate driver is configured to output gate output signals only to the odd numbered gate lines in a first subframe of a first frame, gate output signals only to the even numbered gate lines in a second subframe of the first frame, gate output signals only to the odd numbered gate lines in a first subframe of a second frame and gate output signals only to the even numbered gate lines in a second subframe of the second frame.

18. The display apparatus of claim 14, wherein at least one of the pixels comprises:

a first pixel switching element including a control electrode connected to a first node, an input electrode connected to a second node and an output electrode connected to a third node;

a second pixel switching element including a control electrode to which a data write gate signal is applied, an input electrode to which the data voltage is applied and an output electrode connected to the second node;

a third pixel switching element including a control electrode to which the data write gate signal is applied, an input electrode connected to the first node and an output electrode connected to the third node;

a fourth pixel switching element including a control electrode to which a data initialization gate signal is applied, an input electrode to which the initialization voltage is applied and an output electrode connected to the first node;

a fifth pixel switching element including a control electrode to which the emission signal is applied, an input electrode to which a high power voltage is applied and an output electrode connected to the second node;

a sixth pixel switching element including a control electrode to which the emission signal is applied, an input electrode connected to the third node and an output electrode connected to an anode electrode of an organic light emitting element;

a seventh pixel switching element including a control electrode to which the data initialization gate signal is applied, an input electrode to which an initialization voltage is applied and an output electrode connected to the anode electrode of the organic light emitting element;

a storage capacitor including a first electrode to which the high power voltage is applied and a second electrode connected to the first node; and the organic light emitting element including the anode electrode and a cathode electrode to which a low power voltage is applied.

19. The display apparatus of claim 14, wherein the first stage comprises:

a first switching element comprising a control electrode configured to receive the first clock signal, an input electrode configured to receive the vertical start signal and an output electrode connected to a first control node of the first stage;

a second switching element comprising a control electrode connected to a second control node of the first stage, an input electrode configured to receive a first gate power voltage and an output electrode;

a third switching element comprising a control electrode configured to receive the second clock signal, an input electrode connected to the output electrode of the second switching element of the first stage and an output electrode connected to the first control node of the first stage;

a fourth switching element comprising a control electrode connected to the first control node of the first stage, an input electrode connected to the second control node of the first stage and an output electrode connected to the first control node of the first stage;

a fifth switching element comprising a control electrode configured to receive the first clock signal, an input electrode configured to receive a second gate power voltage different from the first gate power voltage and an output electrode connected to the second control node of the first stage;

a sixth switching element comprising a control electrode connected to the second control node of the first stage, an input electrode configured to receive the first gate power voltage and an output electrode connected to the output terminal of the first stage; and a seventh switching element comprising a control electrode connected to the first control node of the first stage, an input electrode configured to receive the second clock signal and an output electrode connected to the output terminal of the first stage.

20. The display apparatus of claim 19, wherein the second stage comprises:

a first switching element comprising a control electrode configured to receive the second clock signal, an input electrode configured to receive the vertical start signal and an output electrode connected to a first control node of the second stage;

a second switching element comprising a control electrode connected to a second control node of the second stage, an input electrode configured to receive the first gate power voltage and an output electrode;

a third switching element comprising a control electrode configured to receive the first clock signal, an input electrode connected to the output electrode of the second switching element of the second stage and an output electrode connected to the first control node of the second stage;

a fourth switching element comprising a control electrode connected to the first control node of the second stage, an input electrode connected to the second control node of the second stage and an output electrode connected to the first control node of the second stage;

a fifth switching element comprising a control electrode configured to receive the second clock signal, an input electrode configured to receive the second gate power voltage and an output electrode connected to the second control node of the second stage;

a sixth switching element comprising a control electrode connected to the second control node of the second stage, an input electrode configured to receive the first gate power voltage and an output electrode connected to the output terminal of the second stage; and a seventh switching element comprising a control electrode connected to the first control node of the second stage, an input electrode configured to receive the first clock signal and an output electrode connected to the output terminal of the second stage.

* * * * *